US012753582B2

(12) United States Patent
Murakami et al.

(10) Patent No.: US 12,753,582 B2
(45) Date of Patent: Oct. 6, 2026

(54) WORK MACHINE MONITORING SYSTEM AND WORK MACHINE MONITORING METHOD

(71) Applicant: Komatsu Ltd., Tokyo (JP)

(72) Inventors: Yuya Murakami, Tokyo (JP); Shun Kawamoto, Tokyo (JP); Ryohei Emoto, Tokyo (JP); Shoji Sonoyama, Tokyo (JP); Shota Hirama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 15 days.

(21) Appl. No.: 18/835,125

(22) PCT Filed: Feb. 3, 2023

(86) PCT No.: PCT/JP2023/003514
§ 371 (c)(1),
(2) Date: Aug. 1, 2024

(87) PCT Pub. No.: WO2023/149531
PCT Pub. Date: Aug. 10, 2023

(65) Prior Publication Data

US 2025/0389105 A1 Dec. 25, 2025

(30) Foreign Application Priority Data

Feb. 4, 2022 (JP) ..... 2022-016618

(51) Int. Cl.
*E02F 9/26* (2006.01)
*E02F 9/24* (2006.01)

(52) U.S. Cl.
CPC ..... *E02F 9/261* (2013.01); *E02F 9/24* (2013.01)

(58) Field of Classification Search
CPC ..... E02F 9/261; E02F 9/24
See application file for complete search history.

(56) References Cited

U.S. PATENT DOCUMENTS 6,539,294 B1 * 3/2003 Kageyama ..... E02F 3/842 701/25
10,279,680 B2 * 5/2019 Burt ..... B60K 23/0808
(Continued)

FOREIGN PATENT DOCUMENTS

CN 107428316 A 12/2017
CN 109790702 A 5/2019
(Continued)

OTHER PUBLICATIONS

Supplementary European Search Report mailed Dec. 16, 2025, issued in the corresponding European patent application No. 23749847.2.

*Primary Examiner* — Tyler J Lee
(74) *Attorney, Agent, or Firm* — Troutman Pepper Locke LLP

(57) ABSTRACT

A work machine monitoring system includes a measurement data acquisition unit that acquires measurement data of a ground on which a work machine travels by rotation of a rotating member included in the work machine, the rotating member contacting the ground, a boulder determination unit that determines presence or absence of a boulder on the ground in the measurement data, and a warning control unit outputs a warning from an output device based on presence or absence of the boulder on the ground in a traveling direction of the rotating member.

19 Claims, 28 Drawing Sheets

(56) References Cited

U.S. PATENT DOCUMENTS

| | | | | |
|---|---|---|---|---|
| 10,537,062 | B2 * | 1/2020 | Brubaker | A01D 75/30 |
| 11,663,891 | B2 | 5/2023 | Imaizumi et al. | |
| 12,468,303 | B2 * | 11/2025 | Kitai | G01S 7/003 |
| 2011/0160920 | A1 * | 6/2011 | Orr | A01C 23/047 700/283 |
| 2012/0215410 | A1 * | 8/2012 | McClure | G01S 19/14 701/50 |
| 2013/0222573 | A1 | 8/2013 | Onuma et al. | |
| 2017/0320389 | A1 * | 11/2017 | Burt | B60K 23/0808 |
| 2018/0081368 | A1 | 3/2018 | Watanabe et al. | |
| 2018/0196438 | A1 * | 7/2018 | Newlin | G01C 21/3852 |
| 2018/0258616 | A1 | 9/2018 | Kiyota et al. | |
| 2018/0338422 | A1 * | 11/2018 | Brubaker | A01D 41/1208 |
| 2019/0211532 | A1 | 7/2019 | Sakamoto et al. | |
| 2020/0032464 | A1 * | 1/2020 | O'Donnell | G01S 19/14 |
| 2020/0063401 | A1 * | 2/2020 | Sherlock | E02F 9/262 |
| 2021/0019960 | A1 * | 1/2021 | Matsuda | G07C 5/0808 |
| 2021/0191413 | A1 * | 6/2021 | O'Donnell | G05D 1/0227 |
| 2021/0262195 | A1 * | 8/2021 | Nishi | E02F 9/265 |
| 2021/0262196 | A1 * | 8/2021 | Ito | E02F 9/205 |
| 2022/0010526 | A1 * | 1/2022 | Nishi | E02F 9/123 |
| 2022/0132722 | A1 * | 5/2022 | Bomleny | G05D 1/0223 701/41 |
| 2022/0327900 | A1 | 10/2022 | Imaizumi et al. | |
| 2022/0372733 | A1 | 11/2022 | Murakami et al. | |
| 2023/0324917 | A1 * | 10/2023 | Kitai | G01S 17/931 701/28 |

FOREIGN PATENT DOCUMENTS

| | | | |
|---|---|---|---|
| CN | 112639915 | A | 4/2021 |
| JP | 2021-080790 | A | 5/2021 |
| WO | 2019/049288 | A1 | 3/2019 |
| WO | 2021100469 | A1 | 5/2021 |

* cited by examiner

<AI INFERENCE OF BASE AND BLADE EDGE>

<CALCULATING REFERENCE INTER-TOOTH DISTANCE G>

<SEARCHING BLADE EDGE CORRESPONDING TO BASE>

<CALCULATING REFERENCE TOOTH LENGTH L AND DETERMINING DETACHMENT>

<NO-DEFECT DETERMINATION FRAME>

<DEFECT DETERMINATION FRAME>

FIG.21

| SYMBOL | DESCRIPTION |
| --- | --- |
| 1 | BUCKET TOOTH IS UNRECOGNIZED |
| 1 | DETERMINED THAT THERE IS NO DEFECT IN BUCKET TOOTH |
| 1 | DETERMINED THAT THERE IS DEFECT IN BUCKET TOOTH |

WORK MACHINE MONITORING SYSTEM AND WORK MACHINE MONITORING METHOD

CROSS REFERENCE TO RELATED APPLICATIONS

This application is related to the following applications: "WORK MACHINE MONITORING SYSTEM AND WORK MACHINE MONITORING METHOD" in the names of Shun KAWAMOTO, Yuya MURAKAMI, Ryohei EMOTO, Shoji SONOYAMA, and Shota HIRAMA, as a national phase entry of PCT/JP2023/003513; "WORK MACHINE MONITORING SYSTEM AND WORK MACHINE MONITORING METHOD" in the names of Yuya MURAKAMI, Shun KAWAMOTO, Ryohei EMOTO, Shoji SONOYAMA, and Shota HIRAMA, as a national phase entry of PCT/JP2023/003564; "WORK MACHINE MONITORING SYSTEM AND WORK MACHINE MONITORING METHOD" in the names of Yuya MURAKAMI, Shun KAWAMOTO, Ryohei EMOTO, Shoji SONOYAMA, and Shota HIRAMA, as a national phase entry of PCT/JP2023/003565; and which application is assigned to the assignee of the present application and is incorporated by reference herein.

FIELD

The present disclosure relates to a work machine monitoring system and a work machine monitoring method.

BACKGROUND

In a technical field related to a work machine, a work vehicle disclosed in Patent Literature 1 is known.

CITATION LIST

Patent Literature

Patent Literature 1: JP 2021-080790 A

SUMMARY

Technical Problem

There may be a boulder on the ground at a work site. When the work machine steps on the boulder, it may cause a problem in traveling of the work machine.

An object of the present disclosure is to monitor the boulder on the ground.

Solution to Problem

In order to achieve an aspect of the present invention, a monitoring system for a work machine, comprises: a measurement data acquisition unit configured to acquire measurement data of a ground on which the work machine travels by rotation of a rotating member included in the work machine, the rotating member contacting the ground; a boulder determination unit configured to determine presence or absence of a boulder on the ground in the measurement data; and a warning control unit configured to output a warning from an output device based on the presence or absence of the boulder on the ground in a traveling direction of the rotating member.

Advantageous Effects of Invention

According to the present disclosure, it is possible to monitor a boulder on the ground.

BRIEF DESCRIPTION OF DRAWINGS

FIG. 21 is a diagram illustrating an example of a symbol indicating a bucket tooth displayed on a display device according to the embodiment.

DESCRIPTION OF EMBODIMENTS

Hereinafter, embodiments according to the present disclosure will be described with reference to the drawings. However, the present disclosure is not limited to the embodiments. Components of the embodiments described below can be appropriately combined. Further, some components may not be used.

[Work Machine]

Figure 1:
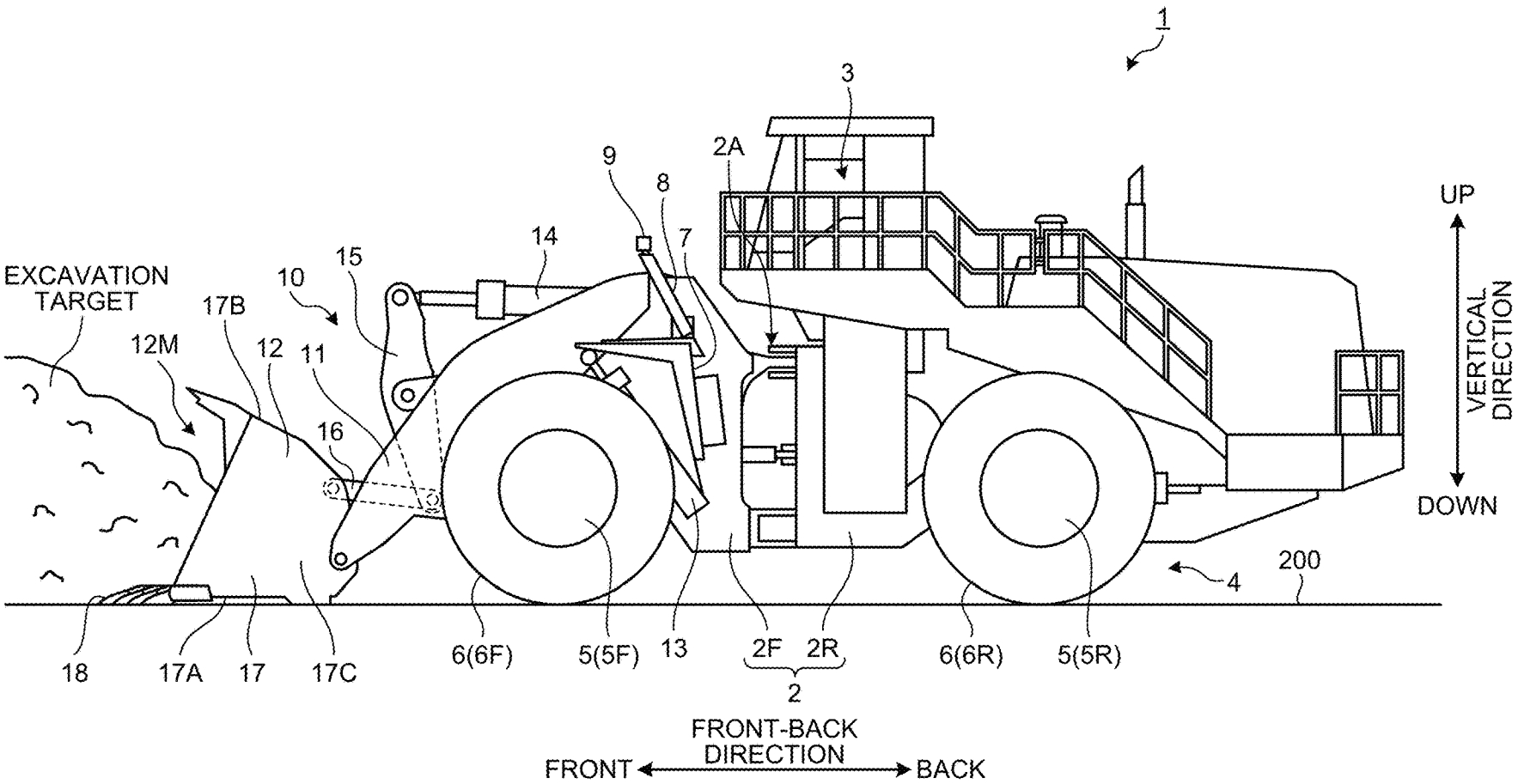
FIG. 1 is a side view illustrating a work machine according to an embodiment.
Figure 2:
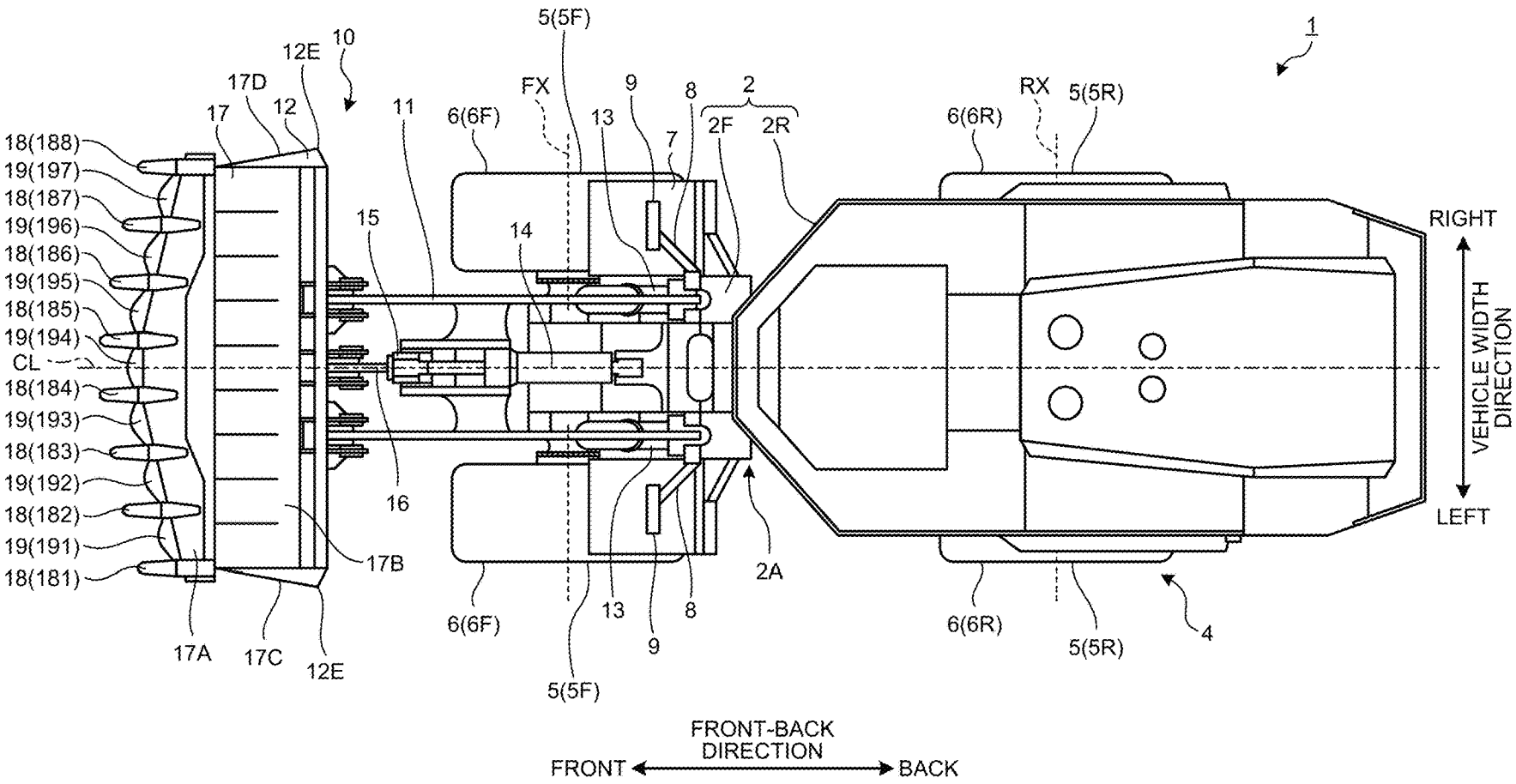
FIG. 2 is a top view illustrating the work machine according to the embodiment.
Figure 3:
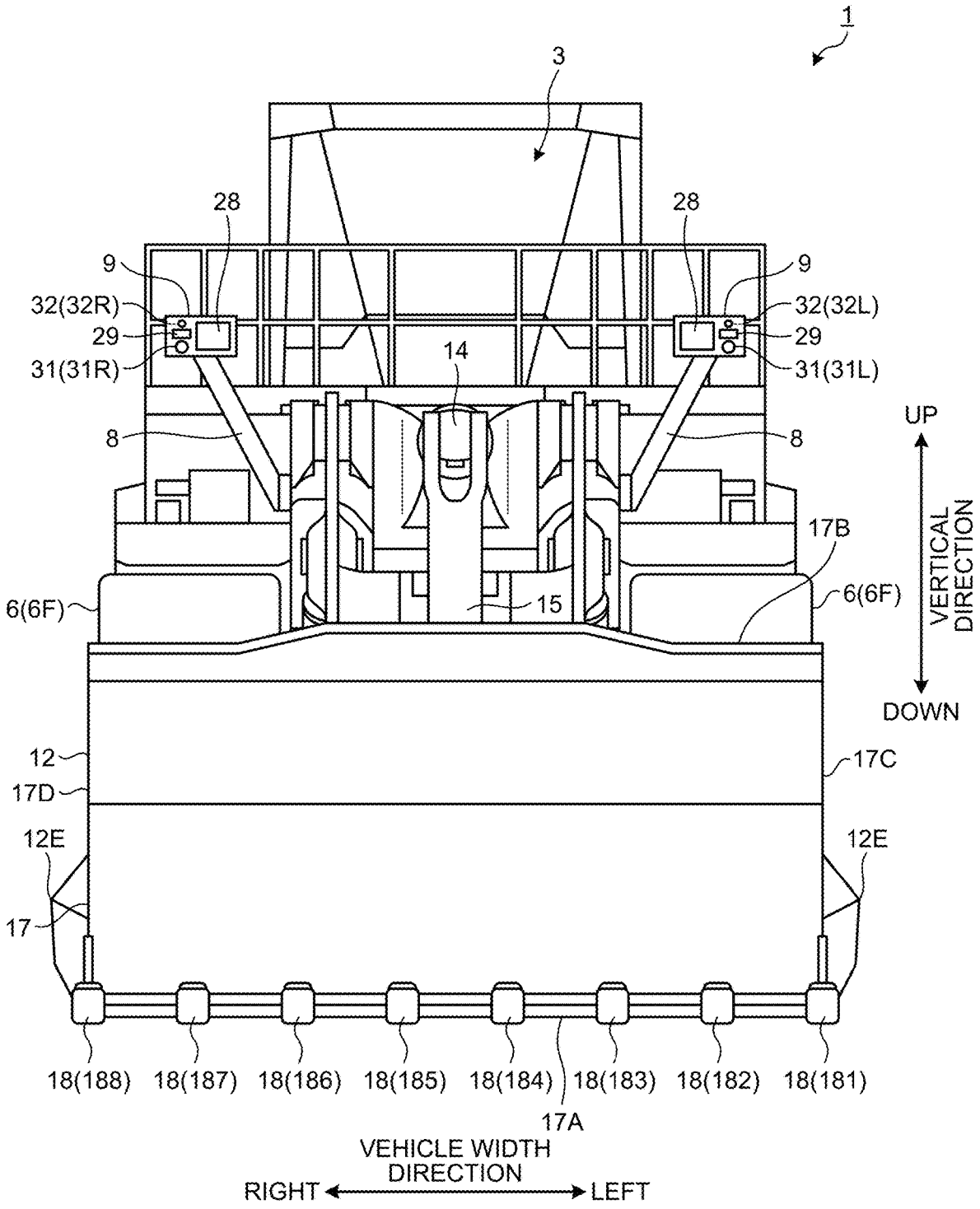
FIG. 3 is a front view illustrating the work machine according to the embodiment.

FIG. 1 is a side view illustrating a work machine 1 according to an embodiment. FIG. 2 is a top view illustrating the work machine 1 according to the embodiment. FIG. 3 is a front view illustrating the work machine 1 according to the embodiment.

The work machine 1 works at a work site. In the embodiment, the work machine 1 is a wheel loader that is a kind of articulated work machine. The work machine 1 performs an excavation work of excavating an excavation target and a loading work of loading an excavated object excavated by the excavation work onto a loading target.

As illustrated in FIGS. 1, 2, and 3, the work machine 1 includes a vehicle body 2, a cab 3, a traveling device 4, a front fender 7, a support 8, a housing 9, and working equipment 10.

The vehicle body 2 includes a front vehicle body 2F and a rear vehicle body 2R. The front vehicle body 2F and the rear vehicle body 2R are connected via a joint mechanism 2A.

The cab 3 is supported by the vehicle body 2. The cab 3 is provided with a driving room. A driver's seat is provided in the driving room. The work machine 1 is operated by a driver on the cab 3.

The traveling device 4 supports the vehicle body 2 and travels on a ground 200 of a work site. The traveling device 4 includes a wheel 5 and a tire 6. The tire 6 is mounted on the wheel 5. The wheel 5 includes a front wheel 5F supported by the front vehicle body 2F and a rear wheel 5R supported by the rear vehicle body 2R. The tire 6 includes a front tire 6F mounted onto the front wheel 5F and a rear tire 6R mounted onto the rear wheel 5R.

The front wheel 5F and the front tire 6F are rotatable about a rotation axis FX. The rear wheel 5R and the rear tire 6R are rotatable about a rotation axis RX.

In the embodiment, a direction parallel to the rotation axis FX of the front wheel 5F is referred to as a vehicle width direction as appropriate. A direction orthogonal to a ground contact surface of the front tire 6F in contact with the ground 200 is referred to as a vertical direction as appropriate. A direction orthogonal to both the vehicle width direction and the vertical direction is referred to as a front-back direction as appropriate. When the vehicle body 2 of the work machine 1 travels straight, the rotation axis FX and the rotation axis RX are parallel to each other.

In the embodiment, a position or a direction close to a center CL of the work machine 1 in the vehicle width direction of the work machine 1 is referred to as an inner side in the vehicle width direction as appropriate, and a position or a direction far from the center CL is referred to as an outer side in the vehicle width direction as appropriate.

One side of the center CL of the work machine 1 in the vehicle width direction is left, and an opposite side of the left is right. A position or a direction close to the working equipment 10 with reference to the driver's seat of the cab 3 in the front-back direction is front, and an opposite side of the front is rear. A position or a direction close to the ground contact surface of the front tire 6F in the vertical direction is bottom, and an opposite side of the bottom is top.

The rear vehicle body 2R is disposed behind the front vehicle body 2F. The front vehicle body 2F is bent leftward and rightward with respect to the rear vehicle body 2R. The rear wheel 5R is disposed behind the front wheel 5F. The rear tire 6R is disposed behind the front tire 6F. The front wheel 5F and the front tire 6F are disposed on the left side and the right side of the center CL of the work machine 1 in the vehicle width direction of the work machine 1. The rear wheel 5R and the rear tire 6R are disposed on the left side and the right side of the center CL of the work machine 1 in the vehicle width direction of the work machine 1.

The tires 6 are rotating members that rotate in contact with the ground 200. The work machine 1 travels on the ground 200 by the rotation of the tires 6. The front tire 6F is a front rotating member that rotates in contact with the ground 200. The rear tire 6R is a rear rotating member that is disposed behind the front tire 6F and rotates in contact with the ground 200.

The front fender 7 prevents earth and sand scattered from the ground 200 during traveling of the work machine 1 from hitting the vehicle body 2 and the cab 3. A part of the front fender 7 is disposed above the front tire 6F. A part of the front fender 7 is disposed on the rear side of the front tire 6F. The front fender 7 is disposed on each of the left side and the right side of the center CL of the work machine 1 in the vehicle width direction of the work machine 1. The front fender 7 on the left side is attached to a left part of the front vehicle body 2F. The front fender 7 on the right side is attached to a right part of the front vehicle body 2F.

The support 8 is a rod-shaped member. A lower end of the support 8 is fixed to the front vehicle body 2F. The support 8 is inclined upward toward the front and outward in the vehicle width direction. The support 8 is disposed on each of the left side and the right side of the center CL of the work machine 1 in the vehicle width direction of the work machine 1. A lower end of the support 8 on the left side is fixed to the left part of the front vehicle body 2F. The support 8 on the left side is inclined upward to the front and left. A lower end of the support 8 on the right side is fixed to the right part of the front vehicle body 2F. The support 8 on the right side is inclined upward to the front and right.

The housing 9 is fixed to an upper end of the support 8. The housing 9 is supported by the front vehicle body 2F via the support 8. In the front-back direction, the housing 9 is disposed between the joint mechanism 2A and a front end of the front vehicle body 2F. In the vertical direction, the housing 9 is disposed between an upper end of the cab 3 and the upper end of the front vehicle body 2F. The housing 9 is disposed on each of the left side and the right side of the center CL of the work machine 1 in the vehicle width direction of the work machine 1. The housing 9 on the left side is fixed to the upper end of the support 8 on the left side. The housing 9 on the right side is fixed to the upper end of the support 8 on the right side. The housing 9 on the left side is disposed above the front fender 7 on the left side. The housing 9 on the right side is disposed above the front fender 7 on the right side.

The working equipment 10 operates in the excavation work and the loading work. The working equipment 10 is connected to the front vehicle body 2F. At least a part of the working equipment 10 is disposed on the front side of the front wheel 5F. The working equipment 10 includes a boom 11, a bucket 12, a bell crank 15, and a bucket link 16.

The boom 11 is rotatably connected to the front vehicle body 2F. The boom 11 connects the front vehicle body 2F and the bucket 12. The boom 11 is operated by a driving force generated by a boom cylinder 13. The boom cylinder 13 is a hydraulic cylinder. One end of the boom cylinder 13 is connected to the front vehicle body 2F. The other end of the boom cylinder 13 is connected to the boom 11. The boom cylinder 13 is disposed on each of the left side and the right side of the center CL of the work machine 1 in the vehicle width direction of the work machine 1.

The bucket 12 excavates the excavation target. The bucket 12 is rotatably connected to a tip end of the boom 11. The bucket 12 is disposed on the front side from the front wheel 5F. The bucket 12 is operated by a driving force generated by a bucket cylinder 14. The bucket cylinder 14 is a hydraulic cylinder. A center of the bell crank 15 is rotatably connected to the boom 11. One end of the bucket cylinder 14 is connected to the front vehicle body 2F. The other end of the bucket cylinder 14 is connected to one end of the bell crank 15. The other end of the bell crank 15 is connected to the bucket 12 via the bucket link 16. One bucket cylinder 14 is disposed at the center in the vehicle width direction.

The bucket 12 includes a bucket body 17, a bucket tooth 18, and an inter-tooth protector 19. The bucket body 17 holds the excavated object. The bucket body 17 includes a lower plate 17A, an upper plate 17B, a left plate 17C, and a right plate 17D. A holding space in which the excavated object is accommodated is formed by the lower plate 17A, the upper plate 17B, the left plate 17C, and the right plate 17D. A tip end of the lower plate 17A and a tip end of the upper plate 17B extend in the vehicle width direction. Each of a tip end of the left plate 17C and a tip end of the right plate 17D extends in the vertical direction or the front-back direction. An opening 12M of the bucket 12 is defined by the tip end of the lower plate 17A, the tip end of the upper plate 17B, the tip end of the left plate 17C, and the tip end of the right plate 17D. The excavated object can enter a holding space of the bucket 12 through the opening 12M.

As illustrated in FIGS. 2 and 3, ends 12E on both sides in the vehicle width direction of the bucket body 17 are disposed outside the tires 6 in the vehicle width direction. A distance in the vehicle width direction between the left end 12E and the right end 12E is larger than a distance in the vehicle width direction between a left side surface of the tire 6 on the left side and a right side surface of the tire 6 on the right side.

The bucket tooth 18 is a blade edge of the bucket 12. The bucket tooth 18 is attached to the bucket body 17. The bucket tooth 18 is attached to the tip end of the lower plate 17A. A plurality of bucket teeth 18 is attached to the bucket body 17. The plurality of bucket teeth 18 is arranged at intervals in the vehicle width direction.

The bucket tooth 18 is a replacement member that is attached to the bucket body 17 in a replaceable manner. For example, the bucket tooth 18 is fixed to the bucket body 17 by a bolt. When the fixing by the bolt is released, the bucket tooth 18 can be detached from the bucket body 17.

In the embodiment, eight bucket teeth 18 are arranged at intervals in the vehicle width direction. The bucket teeth 18 include a bucket tooth 181 arranged on the leftmost side, a bucket tooth 182 arranged on the left side next to the bucket tooth 181, a bucket tooth 183 arranged on the left side next to the bucket tooth 182, a bucket tooth 184 arranged on the left side next to the bucket tooth 183, a bucket tooth 185 arranged on the left side next to the bucket tooth 184, a bucket tooth 186 arranged on the left side next to the bucket tooth 185, a bucket tooth 187 arranged on the left side next to the bucket tooth 186, and a bucket tooth 188 arranged on the rightmost side.

An inter-tooth protector 19 protects the tip end of the lower plate 17A. The inter-tooth protector 19 is attached to the bucket body 17. The inter-tooth protector 19 is arranged between a pair of bucket teeth 18 adjacent to each other. The inter-tooth protector 19 is attached to the tip end of the lower plate 17A. A plurality of inter-tooth protectors 19 is attached to the bucket body 17. The plurality of inter-tooth protectors 19 is arranged at intervals in the vehicle width direction.

The inter-tooth protector 19 is a replacement member that is attached to the bucket body 17 in a replaceable manner. For example, the inter-tooth protector 19 is fixed to the bucket body 17 by a bolt. When the fixing by the bolt is released, the inter-tooth protector 19 can be detached from the bucket body 17.

In the embodiment, seven inter-tooth protectors 19 are arranged at intervals in the vehicle width direction. The inter-tooth protectors 19 include an inter-tooth protector 191 arranged on the leftmost side, an inter-tooth protector 192 arranged on the left side next to the inter-tooth protector 191, an inter-tooth protector 193 arranged on the left side next to the inter-tooth protector 192, an inter-tooth protector 194 arranged on the left side next to the inter-tooth protector 193, an inter-tooth protector 195 arranged on the left side next to the inter-tooth protector 194, an inter-tooth protector 196 arranged on the left side next to the inter-tooth protector 195, and an inter-tooth protector 197 arranged on the rightmost side.

[Driving Room]

Figure 4:
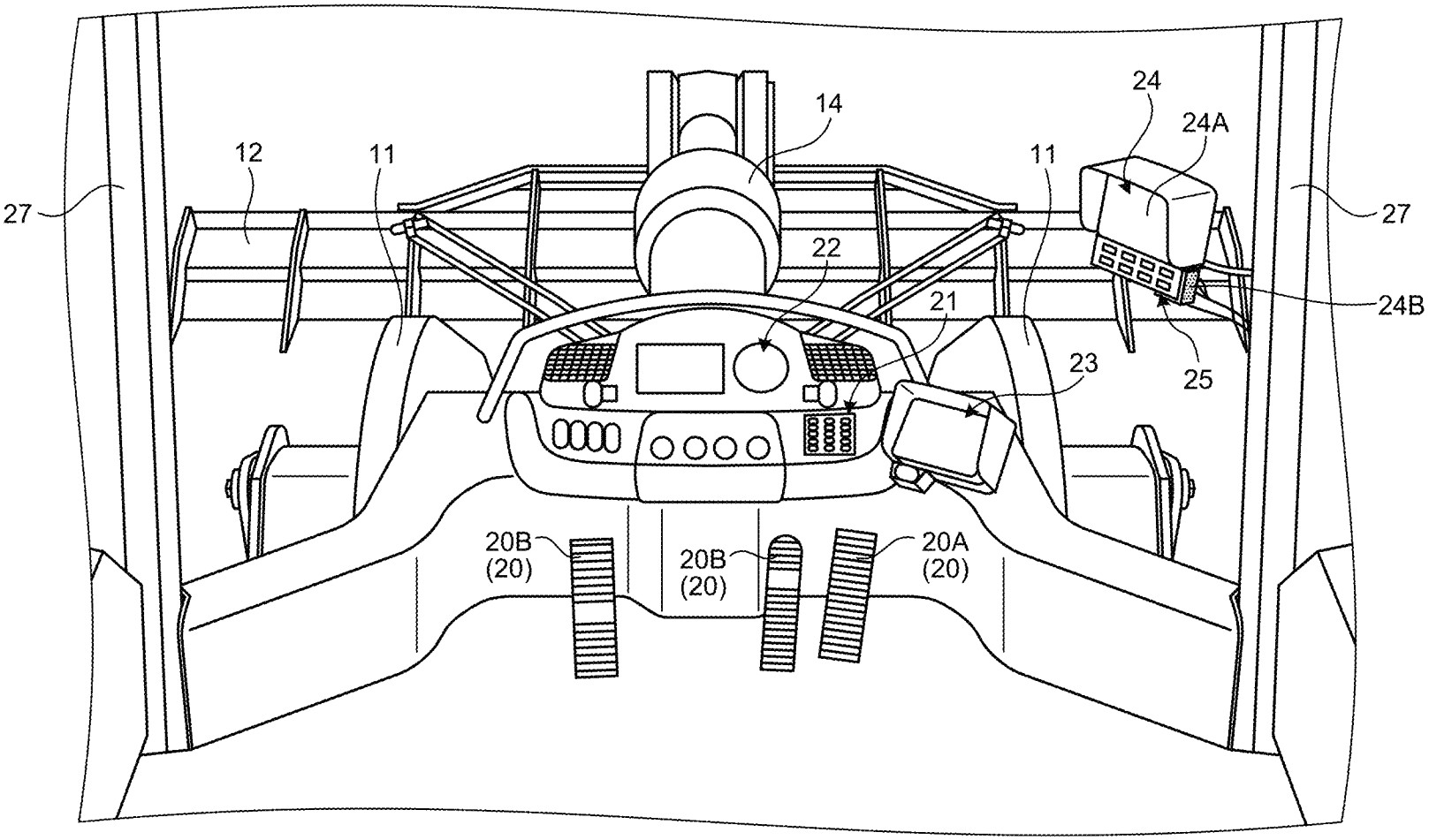
FIG. 4 is a diagram illustrating a driving room of a cab according to the embodiment.

FIG. 4 is a diagram illustrating the driving room of the cab 3 according to the embodiment. FIG. 4 is a diagram schematically illustrating a view seen from a driver seated on the driver's seat in the driving room.

A driving operation device 20, an operation panel 21, a monitor device 22, a rear view monitor device 23, an output device 24, and an input device 25 are disposed in the driving room. The driving operation device 20 is operated by the driver. The driving operation device 20 includes an accelerator pedal 20A and a pair of brake pedals 20B. Although not illustrated, the driving operation device 20 includes a steering lever, a shift lever, a forward/backward changeover switch, and a work lever. A traveling speed of the work machine 1 increases by operating the accelerator pedal 20A. The traveling speed of the work machine 1 decreases or traveling of the work machine 1 stops by operating the brake pedal 20B. The work machine 1 swings by operating the steering lever. A speed stage of the work machine 1 changes by operating the shift lever. A traveling direction of the work machine 1 is switched between forward and backward directions by operating the forward/backward changeover switch. The working equipment 10 moves by operating the work lever.

The output device 24 provides output data to the driver. The output data includes a warning. The output device 24 includes a display device 24A and a sound generator 24B.

The display device 24A provides display data to the driver as the output data. As the display device 24A, a flat panel display such as a liquid crystal display (LCD) or an organic electroluminescence display (OELD) is exemplified.

The sound generator 24B provides sound data to the driver as the output data. As the sound generator 24B, a buzzer or a speaker is exemplified.

The input device 25 is operated by the driver to generate input data. As the input device 25, a button or a keyboard is exemplified. Note that the input device 25 may include, for example, a touch panel.

A windshield is provided at the front of the driving room. The windshield is attached to a pillar 27 of the driving room. In the embodiment, the output device 24 is supported by the pillar 27.

[Measuring Device]

Figure 5:
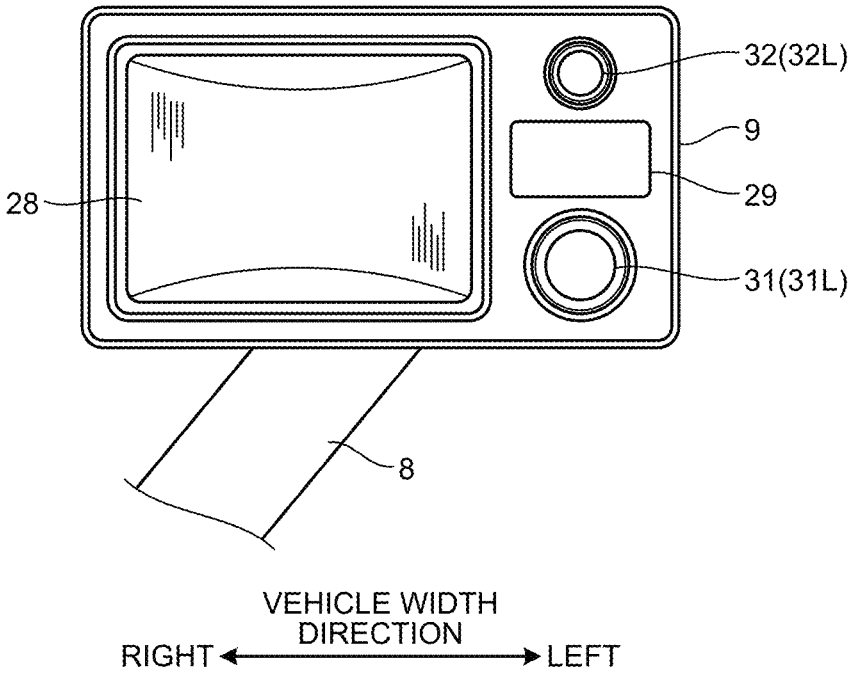
FIG. 5 is an enlarged front view of a part of the work machine according to the embodiment.

FIG. 5 is an enlarged front view of a part of the work machine 1 according to the embodiment. As illustrated in FIGS. 3 and 5, the work machine 1 includes a headlight 28, a blinker lamp 29, a first measuring device 31, and a second measuring device 32.

The headlight 28 emits illumination light forward to illuminate an illumination area in front of the front vehicle body 2F. The headlight 28 is held by the housing 9. The headlight 28 is disposed on each of the left side and the right side of the center CL of the work machine 1 in the vehicle width direction of the work machine 1. The headlight 28 on the left side is held by the housing 9 on the left side. The headlight 28 on the right side is held by the housing 9 on the right side.

The blinker lamp 29 is turned on or blinks to display a swing direction of the work machine 1. The blinker lamp 29 is held by the housing 9. The blinker lamp 29 is disposed on each of the left side and the right side of the center CL of the work machine 1 in the vehicle width direction of the work machine 1. The blinker lamp 29 on the left side is held by the housing 9 on the left side. The blinker lamp 29 on the right side is held by the housing 9 on the right side. The blinker lamp 29 is disposed outside the headlight 28 in the vehicle width direction of the work machine 1.

The first measuring device 31 measures the working equipment 10. The first measuring device 31 acquires measurement data of the working equipment 10. In the embodiment, the first measuring device 31 is an imaging device that captures an image of the working equipment 10. The measurement data of the working equipment 10 includes image data of the working equipment 10. In the following description, the first measuring device 31 is referred to as a first imaging device 31 as appropriate.

The second measuring device 32 measures the ground 200 on which the work machine 1 travels. The second measuring device 32 acquires measurement data of the ground 200. In the embodiment, the second measuring device 32 is an imaging device that captures an image of the ground 200. The measurement data of the ground 200 includes image data of the ground 200. In the following description, the second measuring device 32 is referred to as a second imaging device 32 as appropriate.

Each of the first imaging device 31 and the second imaging device 32 includes an optical system and an image sensor into which light having passed through the optical system enters. As the image sensor, a couple charged device (CCD) image sensor or a complementary metal oxide semiconductor (CMOS) image sensor is exemplified.

Each of the first imaging device 31 and the second imaging device 32 is disposed in the housing 9. In the vehicle width direction of the work machine 1, each of the first imaging device 31 and the second imaging device 32 is disposed outside the headlight 28. In the housing 9, the second imaging device 32 is disposed above the first imaging device 31.

The first imaging device 31 is disposed on each of the left side and the right side of the center CL of the work machine 1 in the vehicle width direction of the work machine 1. The first imaging device 31 is disposed in each of the housing 9 on the left side and the housing 9 on the right side. The first imaging device 31 includes a first imaging device 31L arranged on the left side of the center CL and a first imaging device 31R arranged on the right side of the center CL.

The second imaging device 32 is disposed on each of the left side and the right side of the center CL of the work machine 1 in the vehicle width direction of the work machine 1. The second imaging device 32 is disposed in each of the housing 9 on the left side and the housing 9 on the right side. The second imaging device 32 includes a second imaging device 32L arranged on the left side of the center CL and a second imaging device 32R arranged on the right side of the center CL.

[Drive System]

Figure 6:
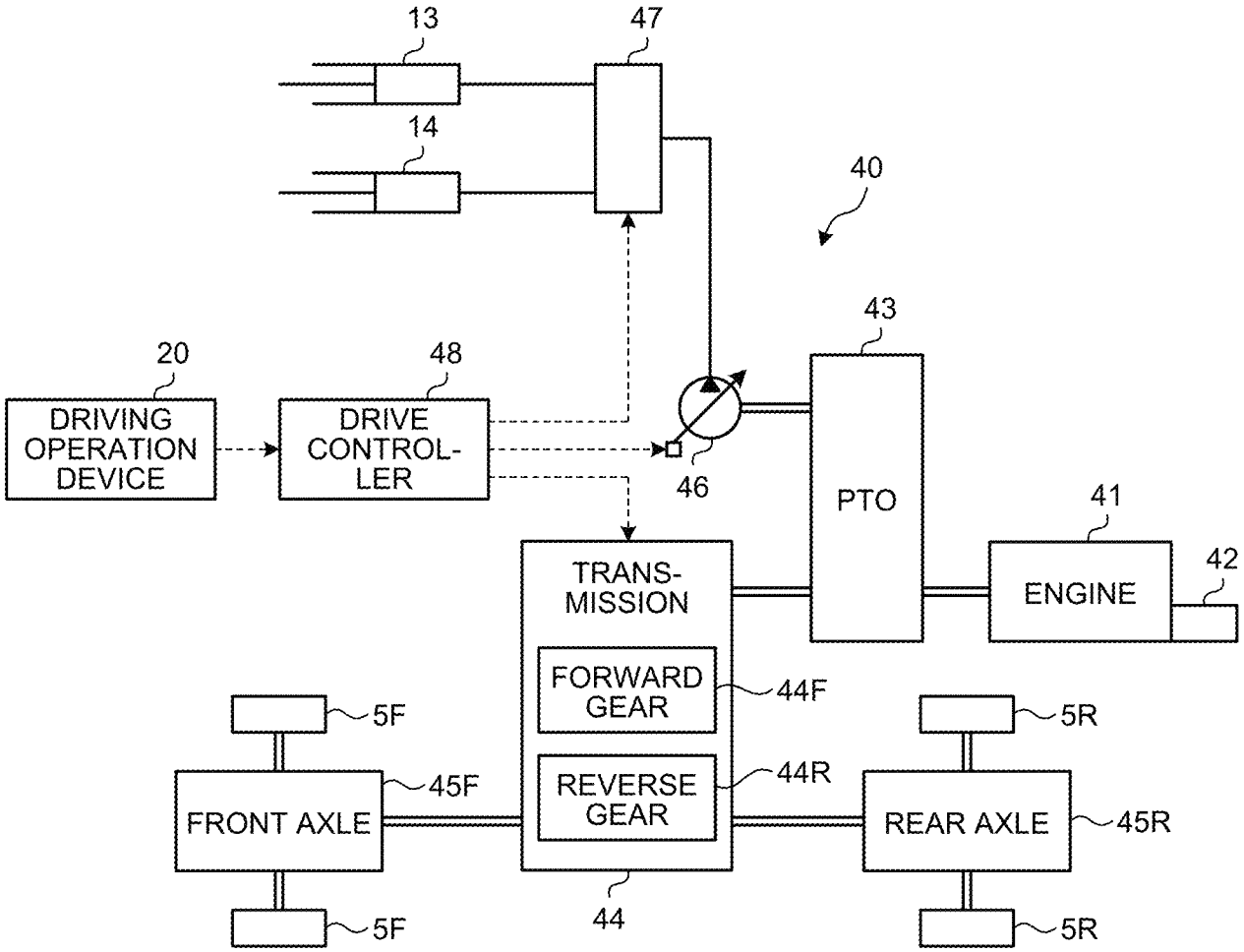
FIG. 6 is a diagram illustrating a drive system of the work machine according to the embodiment.

FIG. 6 is a diagram illustrating a drive system 40 of the work machine 1 according to the embodiment. The drive system 40 includes an engine 41, a fuel injection device 42, a power take off (PTO) 43, a transmission 44, a front axle 45F, a rear axle 45R, a hydraulic pump 46, a control valve 47, and a drive controller 48.

The engine 41 is, for example, a diesel engine. The fuel injection device 42 injects fuel into a cylinder of the engine 41. A driving force of the engine 41 is adjusted by adjusting an amount of fuel injected from the fuel injection device 42 to the engine 41.

The power take-off 43 distributes the driving force of the engine 41 to the transmission 44 and the hydraulic pump 46. The driving force of the engine 41 is transmitted to the transmission 44 and the hydraulic pump 46 via the power take-off 43.

The transmission 44 includes an input shaft to which the driving force of the engine 41 is input and an output shaft that changes a speed of the driving force input to an input shaft and outputs the changed speed. The input shaft of the transmission 44 is connected to the power take-off 43. The output shaft of the transmission 44 is connected to each of the front axle 45F and the rear axle 45R. The driving force of the engine 41 is transmitted to each of the front axle 45F and the rear axle 45R via the power take-off 43 and the transmission 44.

The transmission 44 switches the traveling direction of the work machine 1 between the forward and backward directions. The transmission 44 includes a forward gear 44F and a reverse gear 44R. When the forward gear 44F is engaged, the traveling direction of the work machine 1 is determined to be the forward direction. When the reverse gear 44R is engaged, the traveling direction of the work machine 1 is determined to be the backward direction.

The front axle 45F transmits the driving force transmitted from the transmission 44 to the front wheel 5F. The front wheel 5F rotates according to the driving force transmitted from the front axle 45F.

The rear axle 45R transmits the driving force transmitted from the transmission 44 to the rear wheel 5R. The rear wheel 5R rotates according to the driving force transmitted from the rear axle 45R.

When the forward gear 44F is engaged, the work machine 1 can move forward. When the accelerator pedal 20A is operated and the driving force of the engine 41 is transmitted to each of the front axle 45F and the rear axle 45R via the transmission 44 in a state the forward gear 44F is engaged, the work machine 1 moves forward. Note that, for example, in a state the brake pedal 20B is operated, the work machine 1 does not move forward even in the state the forward gear 44F is engaged.

When the reverse gear 44R is engaged, the work machine 1 can move backward. When the accelerator pedal 20A is operated and the driving force of the engine 41 is transmitted to each of the front axle 45F and the rear axle 45R via the transmission 44 in a state the reverse gear 44R is engaged, the work machine 1 moves backward. Note that, for example, in a state the brake pedal 20B is operated, the work machine 1 does not move backward even in the state the reverse gear 44R is engaged.

The hydraulic pump 46 discharges hydraulic oil. The hydraulic pump 46 is a variable displacement hydraulic pump. The hydraulic pump 46 is driven according to the driving force of the engine 41. The hydraulic oil discharged from the hydraulic pump 46 is supplied to at least one of the boom cylinder 13 and the bucket cylinder 14 via the control valve 47.

The control valve 47 controls a flow rate and a direction of the hydraulic oil supplied to each of the boom cylinder 13 and the bucket cylinder 14. The working equipment 10 is operated by the hydraulic oil supplied from the hydraulic pump 46 via the control valve 47.

The drive controller 48 controls the work machine 1 according to an operation signal output from the driving operation device 20. The drive controller 48 includes a computer system.

[Operation of Working Equipment]

Figure 7:
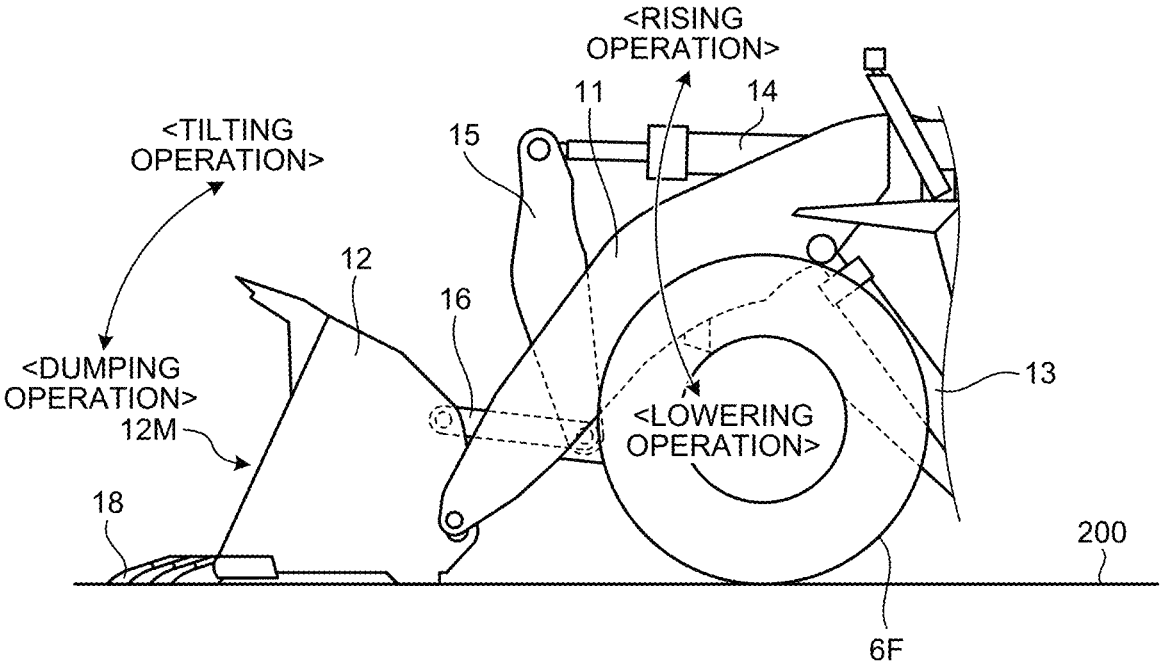
FIG. 7 is a diagram illustrating an operation of working equipment according to the embodiment.

FIG. 7 is a diagram illustrating the operation of the working equipment 10 according to the embodiment. In the embodiment, the working equipment 10 is a front-loading type working equipment in which the opening 12M of the bucket 12 is directed forward in the excavation work.

When the boom cylinder 13 extends and contracts, the boom 11 rises or lowers.

The rising operation of the boom 11 refers to an operation in which the boom 11 rotates such that the tip end of the boom 11 is separated from the ground 200. When the boom cylinder 13 extends, the boom 11 rises.

The lowering operation of the boom 11 refers to an operation in which the boom 11 rotates such that the tip end of the boom 11 approaches the ground 200. When the boom cylinder 13 contracts, the boom 11 lowers.

When the bucket cylinder 14 expands and contracts, the bucket 12 performs a tilting or dumping operation.

The tilting operation of the bucket 12 refers to an operation in which the bucket 12 rotates such that the tip end of the bucket 12 is separated from the ground 200 in a state the opening 12M of the bucket 12 faces upward. As the bucket cylinder 14 extends, the bell crank 15 rotates such that an upper end of the bell crank 15 moves forward and a lower end of the bell crank 15 moves backward. As the lower end of the bell crank 15 moves backward, the bucket 12 is pulled backward by the bucket link 16 and tilts. When the bucket 12 performs the tilting operation, the excavation target is scooped by the bucket 12, and the excavated object is held by the bucket 12.

The dumping operation of the bucket 12 refers to an operation in which the bucket 12 rotates such that the tip end of the bucket 12 approaches the ground 200 in a state the opening 12M of the bucket 12 faces downward. As the bucket cylinder 14 contracts, the bell crank 15 rotates such that the upper end of the bell crank 15 moves backward and the lower end of the bell crank 15 moves forward. When the lower end of the bell crank 15 moves forward, the bucket 12 is pushed forward by the bucket link 16 and performs the dumping operation. When the bucket 12 performs the dumping operation, the excavated object held by the bucket 12 is discharged from the bucket 12.

[Operation of Work Machine]

Figure 8:
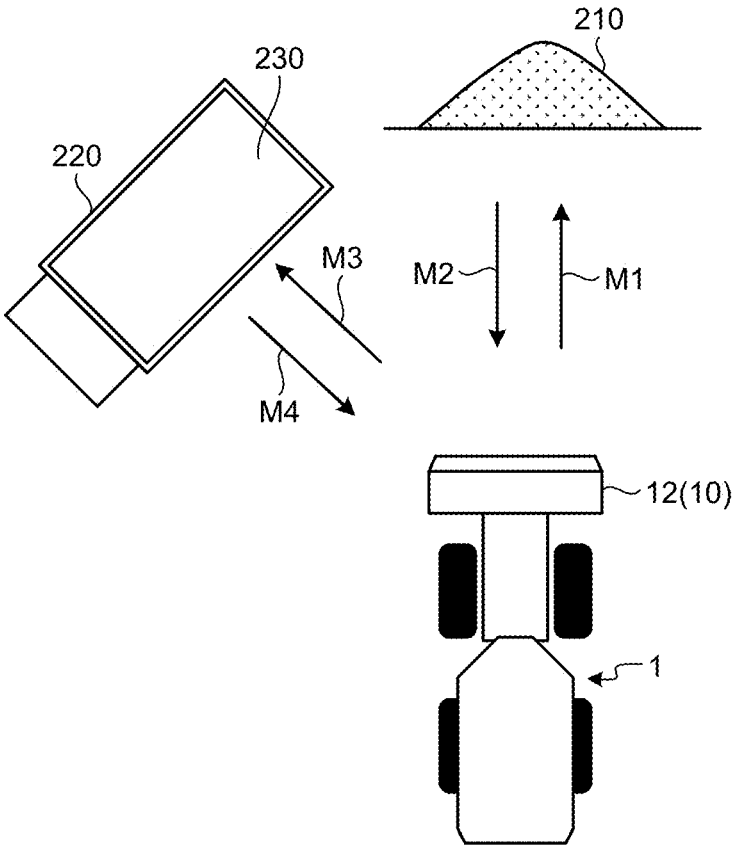
FIG. 8 is a diagram illustrating the operation of the work machine according to the embodiment.

FIG. 8 is a diagram illustrating the operation of the work machine 1 according to the embodiment. The work machine 1 performs the excavation work and the loading work at a work site.

The excavation work is to excavate the excavation target. Examples of the excavation target include natural grounds and rock piles. A natural ground is a pile formed of earth and sand placed on the ground 200. A rock pile is a pile formed of rocks or stones placed on the ground 200. In the embodiment, the excavation target is a natural ground 210. The excavated object is a part of the natural ground 210 excavated and held by the bucket 12.

The loading work is to load the excavated object excavated by the excavation work onto a loading target. Examples of the loading target include a haul vehicle, a hopper, and a belt conveyor. In the embodiment, the loading target is a dump body 230 of a dump truck 220 that is one type of the haul vehicle.

The work machine 1 is operated by the driver to perform a cycle work of repeating a series of work modes. The cycle work includes a plurality of mutually related work modes. The cycle work includes traveling of the traveling device 4 and the operation of the working equipment 10.

In the embodiment, the cycle work includes six work modes. In the embodiment, a series of work modes of the work machine 1 includes an unloaded forward mode, an excavation mode, a loaded backward mode, a loaded forward mode, a loading mode, and an unloaded backward mode.

The order of the series of work modes is fixed. After the unloaded forward mode is performed, the excavation mode is performed. After the excavation mode is performed, the loaded backward mode is performed. After the loaded backward mode is performed, the loaded forward mode is performed. After the loaded forward mode is performed, the loading mode is performed. After the loading mode is performed, the unloaded backward mode is implemented.

The unloaded forward mode is a work mode in which the work machine 1 moves forward so as to approach the excavation target in a state no excavated object is held in the bucket 12. In the unloaded forward mode, the work machine 1 moves forward so as to approach the natural ground 210 as indicated by an arrow M1 in FIG. 8 in the state no excavated object is held in the bucket 12.

The excavation mode is a work mode in which the bucket 12 of the working equipment 10 excavates the excavation target. In the excavation mode, the excavation work is performed. The natural ground 210 is excavated by the bucket 12 and the excavated object is held in the bucket 12 by tilting the bucket 12 in a state that at least a part of the bucket 12 is inserted into the natural ground 210.

The loaded backward mode is a work mode in which the work machine 1 moves backward so as to be separated from the excavation target in a state that the bucket 12 holds the excavated object. In the loaded backward mode, the work machine 1 moves backward so as to be separated from the natural ground 210 as indicated by an arrow M2 in FIG. 8 in the state that the bucket 12 holds the excavated object.

The loaded forward mode is a work mode in which the work machine 1 moves forward so as to approach the loading target in the state that the bucket 12 holds the excavated object. In the loaded forward mode, the work machine 1 moves forward while swinging toward the dump truck 220 as indicated by an arrow M3 in FIG. 8 in the state that the bucket 12 holds the excavated object. In a state that the work machine 1 moves forward toward the dump truck 220, the boom 11 rises so that the bucket 12 is located above the dump body 230.

The loading mode is a work mode in which the excavated object held in the bucket 12 of the working equipment 10 is loaded onto the loading target. In the loading mode, the loading work is performed. After the bucket 12 is located above the dump body 230, the bucket 12 performs the dumping operation, whereby the excavated object held in the bucket 12 is discharged from the bucket 12 and loaded into the dump body 230.

The unloaded backward mode is a work mode in which the work machine 1 moves backward so as to be separated from the loading target in the state no excavated object is held in the bucket 12. The work machine 1 moves backward while swinging so as to be separated from the dump truck 220 as indicated by an arrow M4 in FIG. 8 in the state no excavated object is held in the bucket 12.

The work machine 1 repeats the cycle work including the unloaded forward mode, the excavation mode, the loaded backward mode, the loaded forward mode, the loading mode, and the unloaded backward mode until a target loading amount of the excavated object is loaded onto the dump body 230.

[Measuring Range]

Figure 9:
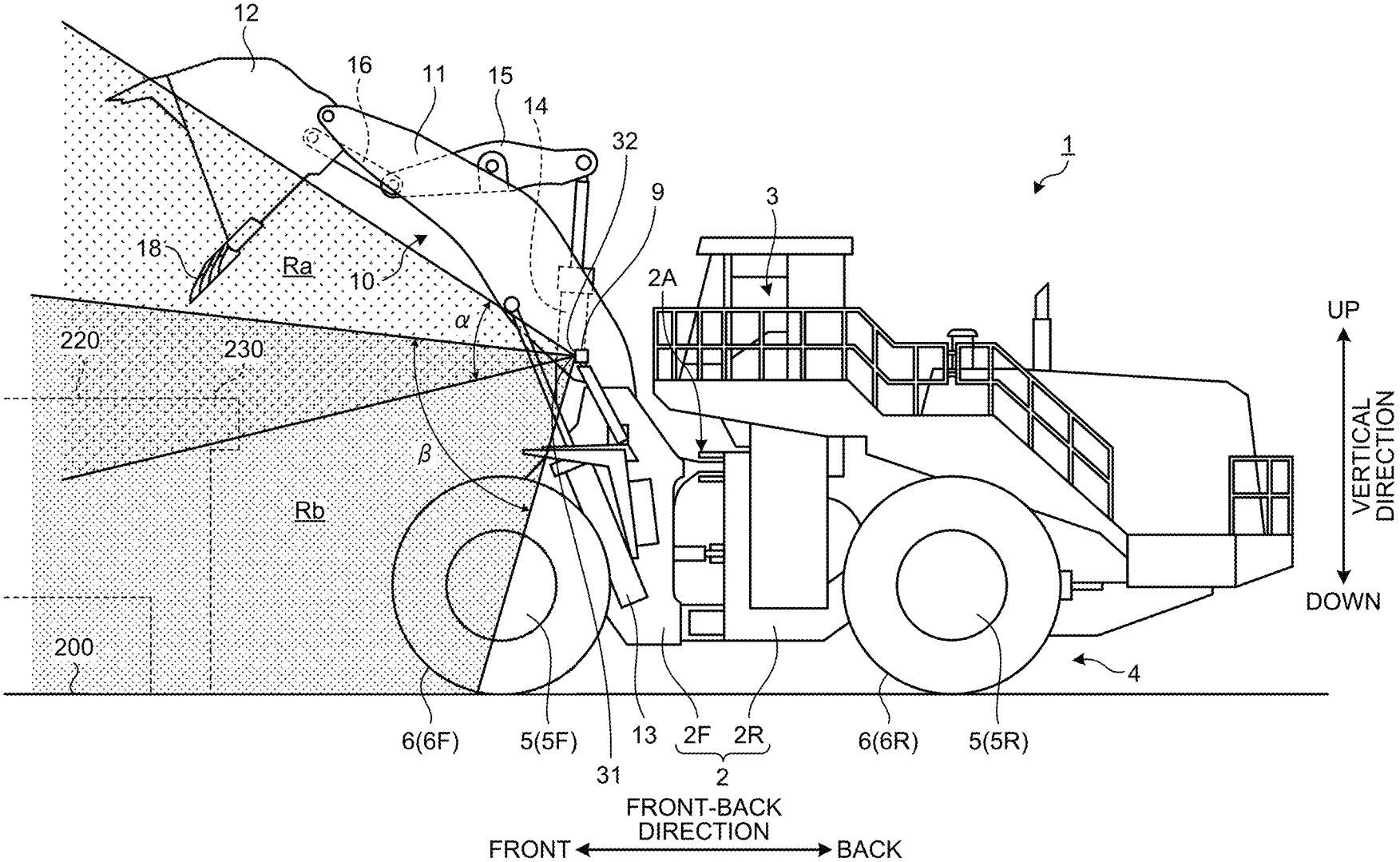
FIG. 9 is a side view illustrating the work machine that performs a loading work according to the embodiment.
Figure 10:
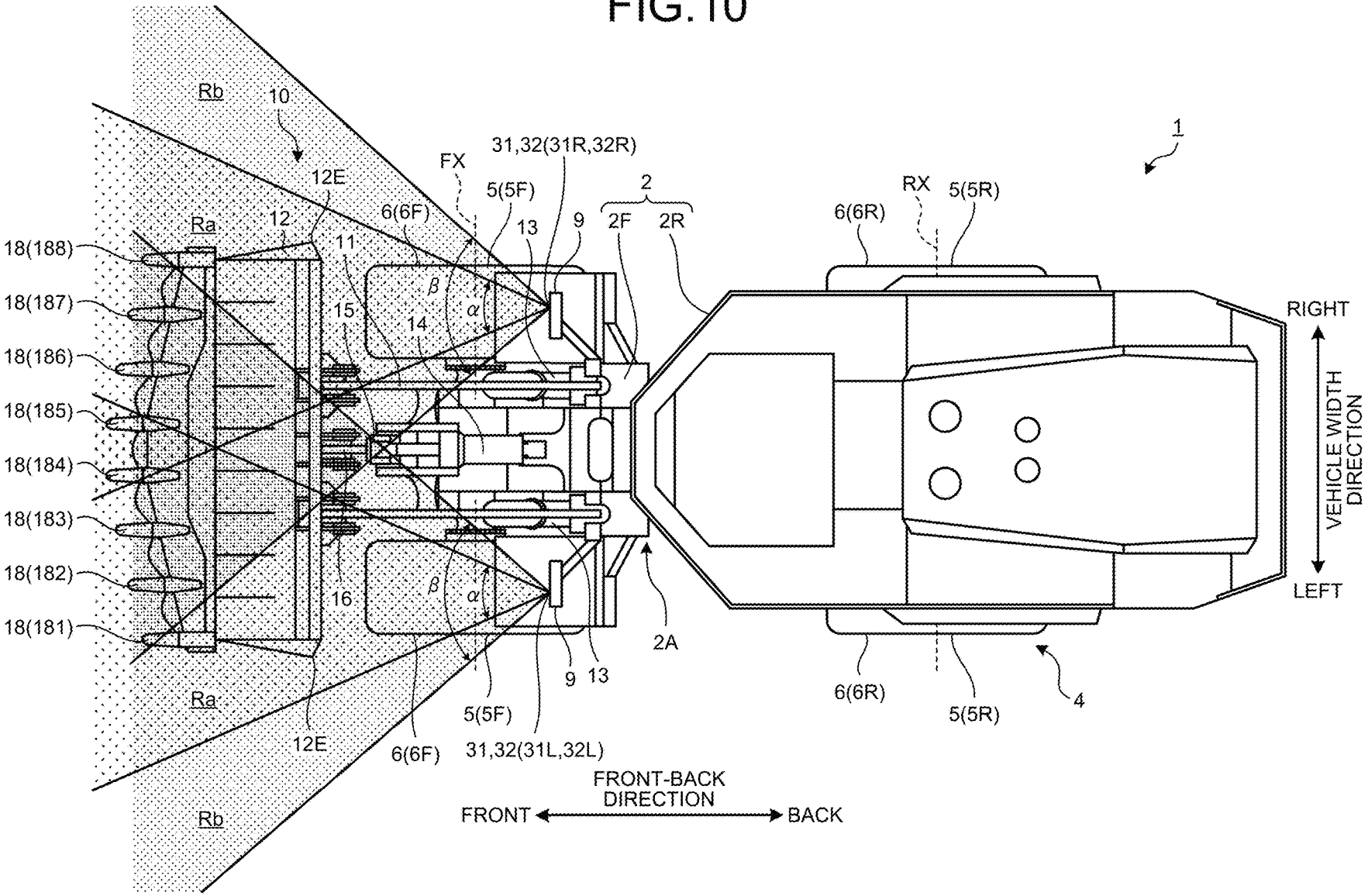
FIG. 10 is a top view illustrating the work machine that performs the loading work according to the embodiment.

FIG. 9 is a side view illustrating the work machine 1 that performs the loading work according to the embodiment. FIG. 10 is a top view illustrating the work machine 1 that performs the loading work according to the embodiment.

As illustrated in FIGS. 9 and 10, when the excavated object is loaded onto the dump body 230 of the dump truck 220, the work machine 1 performs the rising operation of the boom 11 so that the bucket 12 is located above the dump body 230. After the boom 11 rises and the bucket 12 is located above the dump body 230, the work machine 1 causes the bucket 12 to perform the dumping operation. The bucket 12 performs the dumping operation such that the excavated object held in the bucket 12 is discharged to the dump body 230 of the dump truck 220 in a state that the boom 11 is raised. The first imaging device 31 images at least the bucket 12 performing the dumping operation in order to discharge the excavated object to the dump body 230. By the dumping operation of the bucket 12, the excavated object held in the bucket 12 is discharged from the bucket 12 and loaded into the dump body 230.

A measuring range Ra of the first imaging device 31 includes an imaging range of the first imaging device 31. The measuring range Ra is determined based on a first angle of view $\alpha$ indicating an angle of view of an optical system of the first imaging device 31. The first imaging device 31 images the bucket 12 performing the dumping operation in order to discharge the excavated object to the dump body 230. The first imaging device 31 is fixed to the housing 9 such that the bucket teeth 18 are arranged in the measuring range Ra when the boom 11 rises and the bucket 12 performs the dumping operation.

A measuring range Rb of the second imaging device 32 includes an imaging range of the second imaging device 32. The measuring range Rb is determined based on a second angle of view $\beta$ indicating an angle of view of an optical system of the second imaging device 32. The second imaging device 32 images at least the ground 200 in the traveling direction of the tires 6. In the embodiment, when the work machine 1 moves forward, the second imaging device 32 images the ground 200 in front of the front tires 6F. The second imaging device 32 is fixed to the housing 9 such that at least the ground 200 in front of the front tires 6F is arranged in the measuring range Rb when the work machine 1 moves forward. In the embodiment, the second imaging device 32 is fixed to the housing 9 such that each of the front end of the front tires 6F, the ground 200 in front of the front tires 6F, and the ground 200 outside the front tires 6F in the vehicle width direction is arranged in the measuring range Rb. The ground 200 in front of the front tires 6F includes the ground 200 between the front end of the front tires 6F and the rear end of the bucket 12 in the front-back direction.

In the embodiment, the second angle of view $\beta$ of the second imaging device 32 is wider than the first angle of view $\alpha$ of the first imaging device 31.

As illustrated in FIG. 10, the first imaging device 31L on the left side of the center CL images at least a left part of the bucket 12 of the working equipment 10. The first imaging device 31R on the right side of the center CL images at least a right part of the bucket 12 of the working equipment 10. The left part of the bucket 12 is a part of the bucket 12 between the left end 12E of the bucket 12 and the center CL. The right part of the bucket 12 is a part of the bucket 12 between the right end 12E of the bucket 12 and the center CL.

In the example illustrated in FIG. 10, the first imaging device 31L on the left side of the center CL is fixed to the housing 9 on the left side such that the bucket teeth 181, 182, 183, 184, and 185 are arranged in the measuring range Ra when the boom 11 is raised and the bucket 12 performs the dumping operation. The first imaging device 31R on the right side of the center CL is fixed to the housing 9 on the right side such that the bucket teeth 184, 185, 186, 187, and 188 are arranged in the measuring range Ra when the boom 11 is raised and the bucket 12 performs the dumping operation.

As illustrated in FIG. 10, the second imaging device 32L on the left side of the center CL images the ground 200 in front of the front tire 6F on the left side of the center CL. The second imaging device 32R on the right side of the center CL images the ground 200 in front of the front tire 6F on the right side of the center CL.

In the example illustrated in FIG. 10, the second imaging device 32L on the left side of the center CL is fixed to the housing 9 on the left side such that the front end of the front tire 6F on the left side, the ground 200 in front of the front tire 6F on the left side, and the ground 200 on the left side of the front tire 6F on the left side are arranged in the measuring range Rb. The second imaging device 32R on the right side of the center CL is fixed to the housing 9 on the right side such that the front end of the front tire 6F on the right side, the ground 200 in front of the front tire 6F on the right side, and the ground 200 on the right side of the front tire 6F on the right side are arranged in the measuring range Rb.

Figure 11:
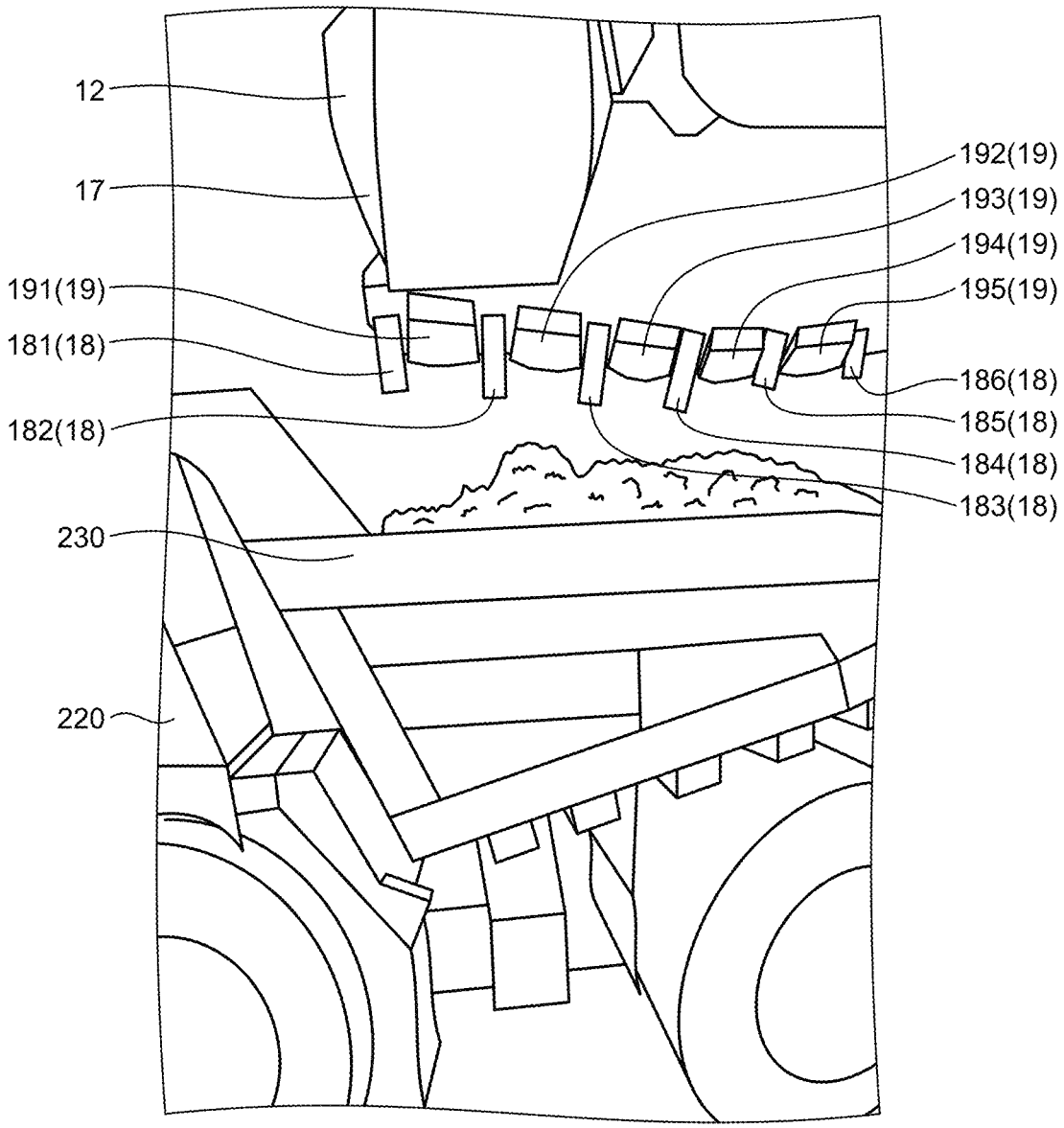
FIG. 11 is a diagram illustrating an example of imaging data imaged by a first imaging device on the left according to the embodiment.
Figure 12:
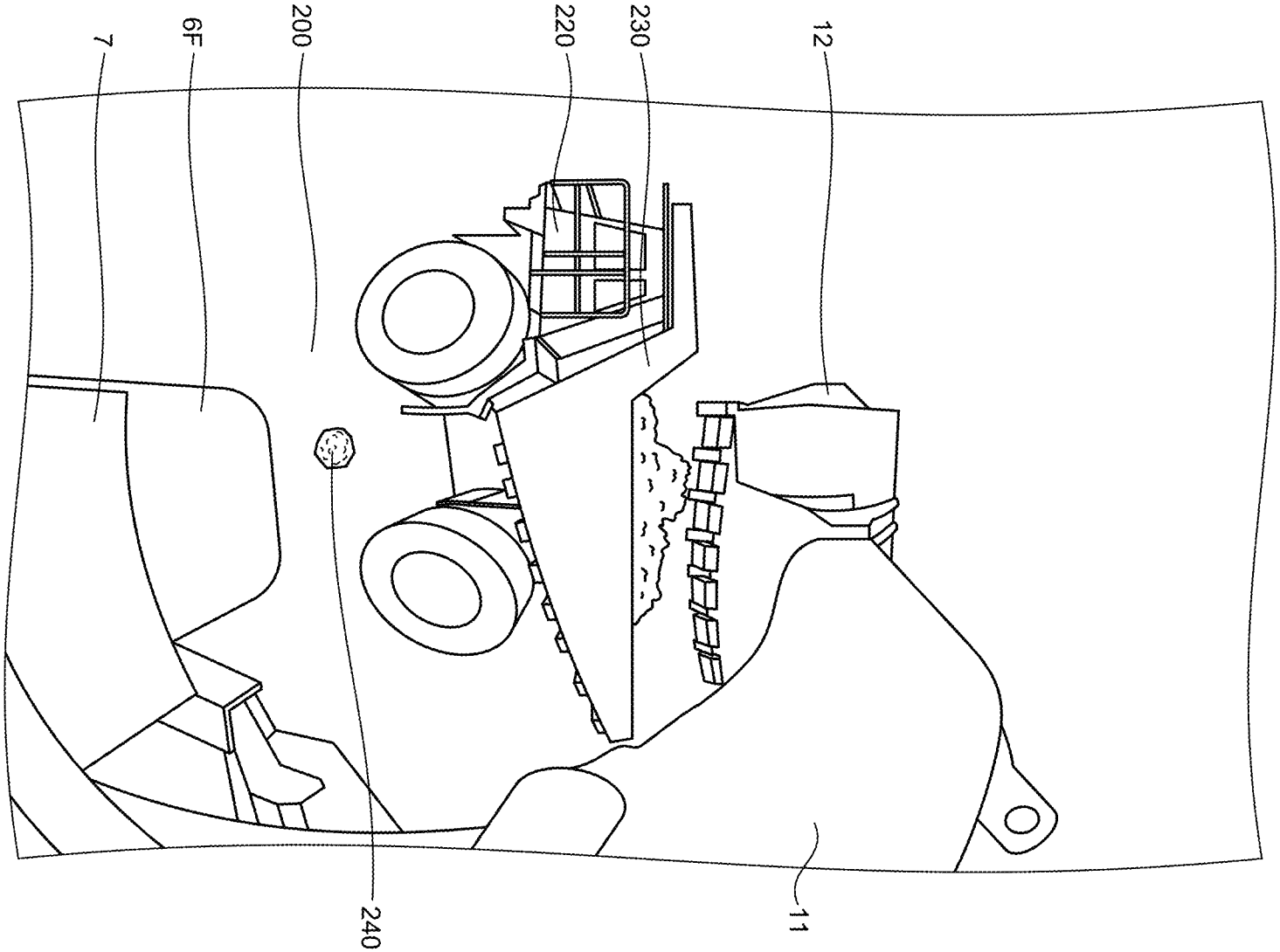
FIG. 12 is a diagram illustrating an example of imaging data imaged by a second imaging device on the left according to the embodiment.

FIG. 11 is a diagram illustrating an example of image data captured by the first imaging device 31L on the left side according to the embodiment. FIG. 12 is a diagram illustrating an example of image data captured by the second imaging device 32R on the left side according to the embodiment.

As illustrated in FIG. 11, the first imaging device 31L images, from below upward, the bucket 12 performing the dumping operation so as to discharge the excavated object to the dump body 230. As a result, as illustrated in FIG. 11, the first imaging device 31L can simultaneously image a plurality of bucket teeth 18. In the example illustrated in FIG. 11, the bucket teeth 181, 182, 183, 184, 185, and 186 are arranged in the measuring range Ra of the first imaging device 31.

As illustrated in FIG. 12, the second imaging device 32L images, from above downward, the ground 200 in front of the front tires 6F and the ground 200 on the left side. As a result, the second imaging device 32L can image the ground 200 around the front tire 6F. For example, when a boulder 240 exists on the ground 200 around the front tire 6F, the second imaging device 32L can capture the boulder 240 on the ground 200.

[Monitoring System]

Figure 13:
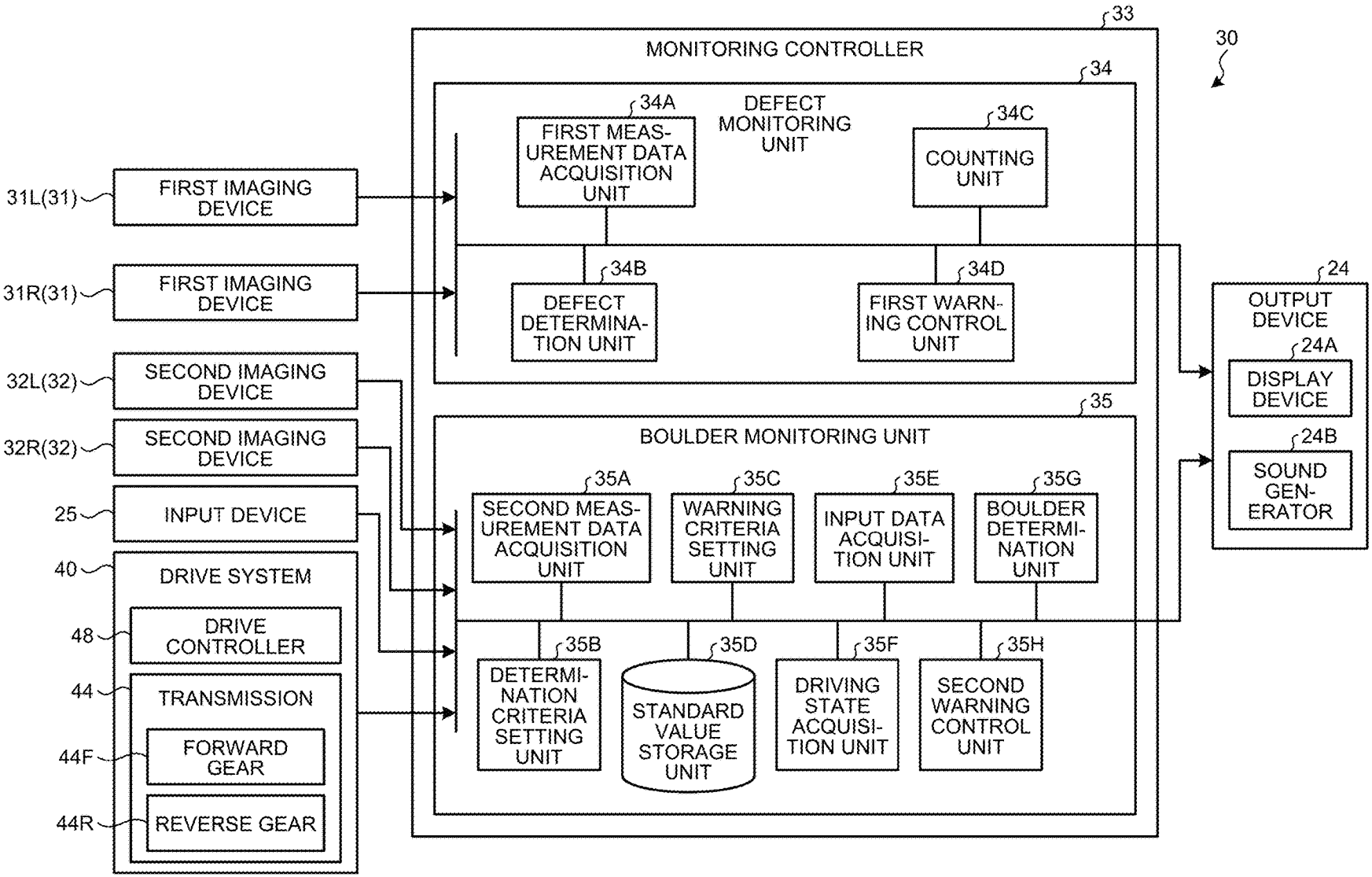
FIG. 13 is a functional block diagram illustrating a monitoring system according to the embodiment.

FIG. 13 is a functional block diagram illustrating a monitoring system 30 according to the embodiment. The work machine 1 includes the monitoring system 30. The monitoring system 30 monitors the working equipment 10 and the ground 200 on which the work machine 1 travels.

The monitoring system 30 includes the first imaging device 31, the second imaging device 32, the output device 24, the input device 25, and a monitoring controller 33. The first imaging device 31 includes a first imaging device 31L arranged on the left side of the center CL and a first imaging device 31R arranged on the right side of the center CL. The second imaging device 32 includes a second imaging device 32L arranged on the left side of the center CL and a second imaging device 32R arranged on the right side of the center CL.

Each of the first imaging device 31, the second imaging device 32, the output device 24, and the input device 25 is connected to the monitoring controller 33. Image data captured by the first imaging device 31 is input to the monitoring controller 33. Image data captured by the second imaging device 32 is input to the monitoring controller 33. Input data generated by the input device 25 is input to the monitoring controller 33.

In the embodiment, each of the first imaging device 31 and the second imaging device 32 acquires measurement data at a predetermined sampling rate (samples per second (SPS)). The measurement data includes image data. The sampling rate includes a frame rate (frames per second (FPS)). Each of the first imaging device 31 and the second imaging device 32 captures the image data at a predetermined frame rate. A moving image is captured by imaging the image data at the predetermined frame rate by the first imaging device 31. A moving image is captured by imaging the image data at the predetermined frame rate by the second imaging device 32

The monitoring controller 33 includes a defect monitoring unit 34 and a boulder monitoring unit 35.

The defect monitoring unit 34 recognizes the presence of a defect in the working equipment 10 based on the image data captured by the first imaging device 31. When the defect in the working equipment 10 is recognized, the defect monitoring unit 34 causes the output device 24 to output a warning indicating that there is a defect in the working equipment 10. The defect in the working equipment 10 includes a defect in the bucket 12. The defect in the bucket 12 includes a defect in the bucket tooth 18 that is a replacement member. The defect in the bucket tooth 18 includes detachment of the bucket tooth 18 from the bucket body 17.

The boulder monitoring unit 35 recognizes, based on the imaging data imaged by the second imaging device 32, the presence of the boulder 240 on the ground 200 on which the work machine 1 travels. When the boulder 240 on the ground 200 is recognized, the boulder monitoring unit 35 causes the output device 24 to output a warning indicating that the boulder 240 is present on the ground 200. The boulder 240 on the ground 200 includes the boulder 240 on the ground 200 in the traveling direction of the front tires 6F. The boulder 240 on the ground 200 in the traveling direction of the front tires 6F includes the boulder 240 on the ground 200 in front of the front tire 6F when the work machine 1 moves forward.

<Defect Monitoring Unit>

The defect monitoring unit 34 includes a first measurement data acquisition unit 34A, a defect determination unit 34B, a counting unit 34C, and a first warning control unit 34D.

The first measurement data acquisition unit 34A acquires measurement data of the working equipment 10 from the first imaging device 31 at the predetermined sampling rate. In the embodiment, the measurement data of the working equipment 10 includes image data of the working equipment 10 captured by the first imaging device 31. The sampling rate includes the frame rate. The first measurement data acquisition unit 34A acquires the image data of the working equipment 10 from the first imaging device 31 at the predetermined frame rate.

The defect determination unit 34B determines the presence of a defect in the working equipment 10 based on the image data acquired by the first measurement data acquisition unit 34A. The defect determination unit 34B determines the presence of a defect in the working equipment 10 based on the image data. In the embodiment, the defect determination unit 34B determines detachment of the bucket tooth 18 from the bucket body 17 based on the image data.

Each of FIGS. 14, 15, 16, 17, and 18 is a diagram illustrating a defect determination method by the defect determination unit 34B according to the embodiment. Hereinafter, as an example, a method of determining the presence of a defect in the bucket tooth 18 based on the image data captured by the first imaging device 31L on the left side of the center CL will be described.

Figure 14:
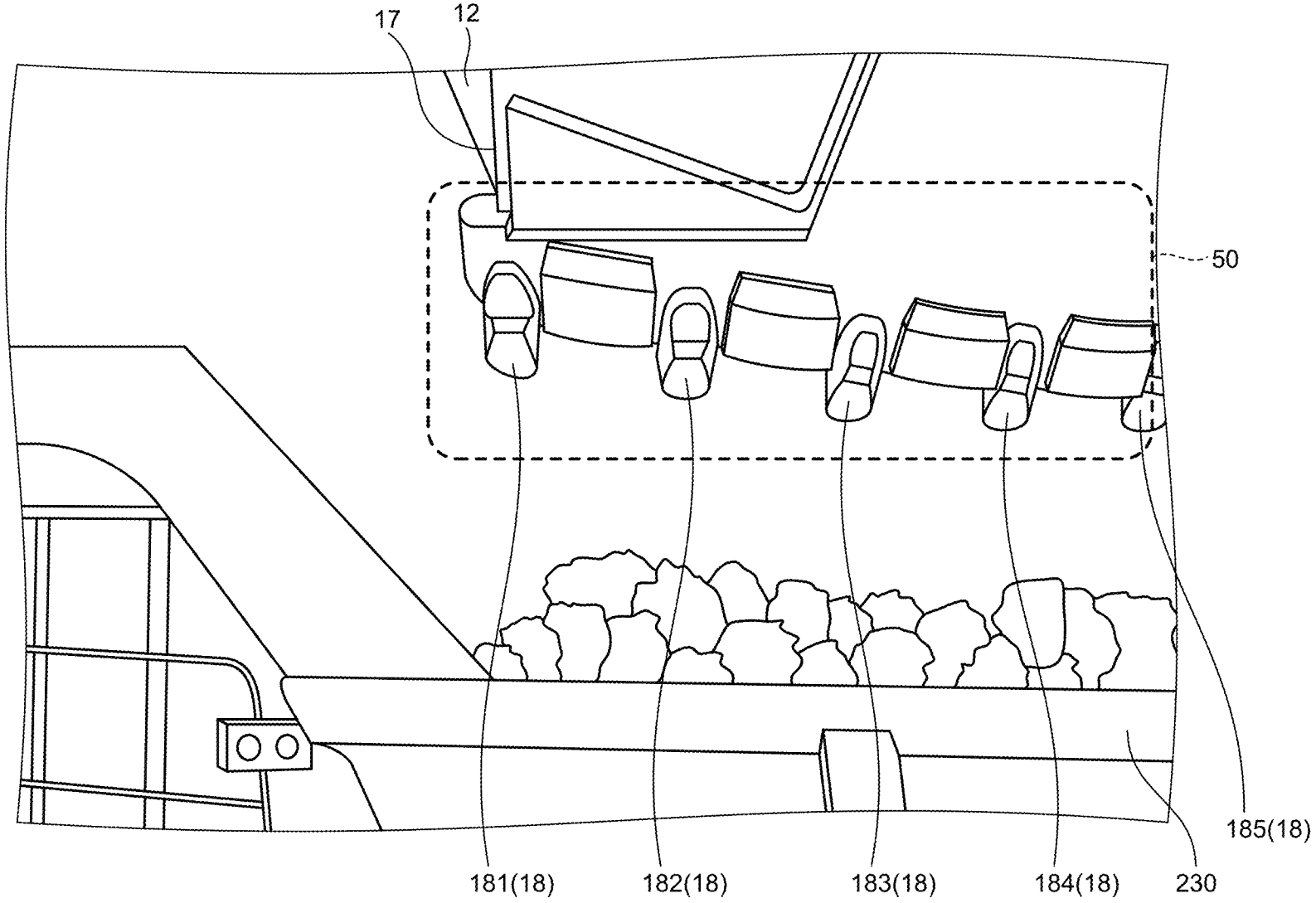
FIG. 14 is a diagram illustrating a defect determination method by a defect determination unit according to the embodiment.

As illustrated in FIG. 14, the first imaging device 31L images the bucket 12 performing the dumping operation in order to discharge the excavated object to the dump body 230. The first measurement data acquisition unit 34A acquires the image data of the bucket 12 from the first imaging device 31L. The plurality of bucket teeth 18 (181, 182, 183, 184, and 185) is arranged in a recognition range 50 of the image data. Each of the plurality of bucket teeth 18 is attached to the bucket body 17 so as to protrude from the bucket body 17.

The defect determination unit 34B recognizes each of the plurality of bucket teeth 18 in the recognition range 50 of the image data acquired by the first measurement data acquisition unit 34A.

Figure 15:
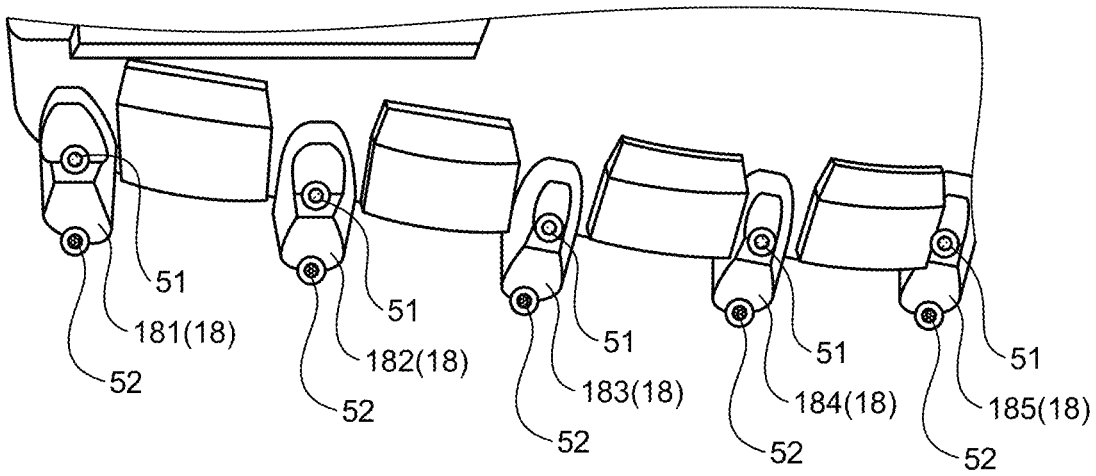
FIG. 15 is a diagram illustrating the defect determination method by the defect determination unit according to the embodiment.

After recognizing the plurality of bucket teeth 18, as illustrated in FIG. 15, the defect determination unit 34B estimates the position of a base 51 and the position of a blade edge 52 of each of the plurality of bucket teeth 18. The base 51 is a base end of the bucket tooth 18. The base 51 includes a boundary between the bucket tooth 18 and the bucket body 17. The blade edge 52 is a tip end of the bucket tooth 18. In the embodiment, the defect determination unit 34B estimates the base 51 and the blade edge 52 using artificial intelligence (AI) that analyzes the input data by an algorithm and outputs the output data. The defect determination unit 34B may estimate a center where a probability is equal to or greater than a predetermined threshold as the position of the base 51 and the position of the blade edge 52, using artificial intelligence that outputs a probability of certainty of the base 51 and the blade edge 52 based on the input data. In addition, the defect determination unit 34B may use artificial intelligence that directly estimates the position of the base 51 and the position of the blade edge 52 based on the input data.

Figure 16:
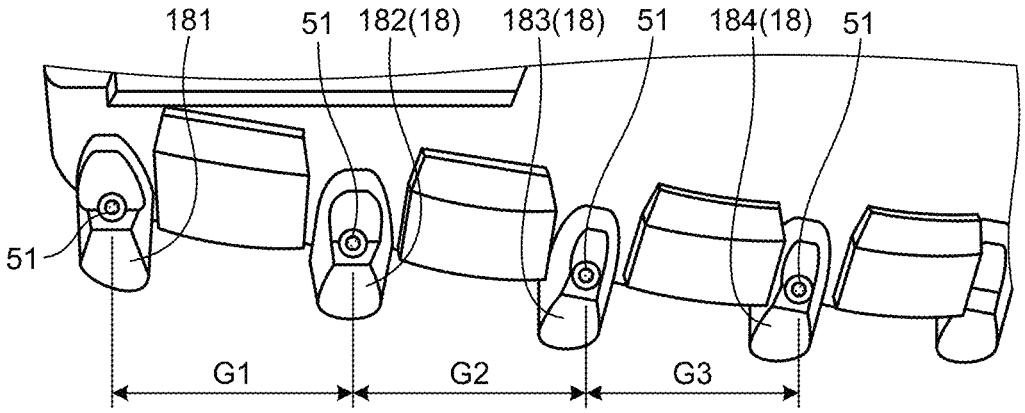
FIG. 16 is a diagram illustrating the defect determination method by the defect determination unit according to the embodiment.

After estimating the position of the base 51 and the position of the blade edge 52 of each of at least four bucket teeth 181, 182, 183, and 184, as illustrated in FIG. 16, the defect determination unit 34B calculates a distance G1 between the base 51 of the bucket tooth 181 and the base 51 of the bucket tooth 182, a distance G2 between the base 51 of the bucket tooth 182 and the base 51 of the bucket tooth 183, and a distance G3 between the base 51 of the bucket tooth 183 and the base 51 of the bucket tooth 184. After calculating the distances G1, G2, and G3, the defect determination unit 34B calculates a reference inter-tooth distance G based on the distances G1, G2, and G3. In the embodiment, the reference inter-tooth distance G is a median value of the distances G1, G2, and G3.

Figure 17:
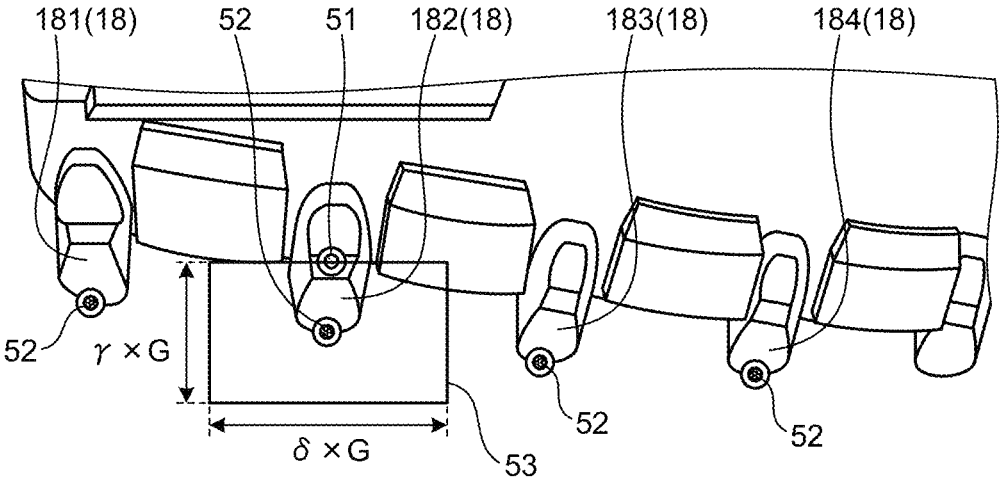
FIG. 17 is a diagram illustrating the defect determination method by the defect determination unit according to the embodiment.

After calculating the reference inter-tooth distance G, as illustrated in FIG. 17, the defect determination unit 34B searches the blade edge 52 corresponding to the base 51. The base 51 and the blade edge 52 corresponding to the base 51 configure the base end and the tip end of one bucket tooth 18. In the embodiment, the defect determination unit 34B sets a search range 53 with the base 51 as a reference, and searches the blade edge 52 in the search range 53. The search range 53 is set in a rectangular shape in the image data. As illustrated in FIG. 17, a dimension of the search range 53 in the vertical direction in the image data is defined as [γ×G], and a dimension of the search range 53 in the horizontal direction in the image data is defined as [δ×G]. These Y and δ are predetermined fixed values.

Note that the bucket 12 appears large in the image data captured by the first imaging device 31L when a distance between the first imaging device 31L and the bucket 12 is short. The bucket 12 appears small in the image data captured by the first imaging device 31L when the distance between the first imaging device 31L and the bucket 12 is long. When the size of the bucket 12 is different in the image data, the defect determination unit 34B may not be able to search the blade edge 52 corresponding to the base 51. In the embodiment, the search range 53 is set based on the reference inter-tooth distance G. As a result, the defect determination unit 34B can search the blade edge 52 corresponding to the base 51 regardless of the distance between the first imaging device 31L and the bucket 12.

Figure 18:
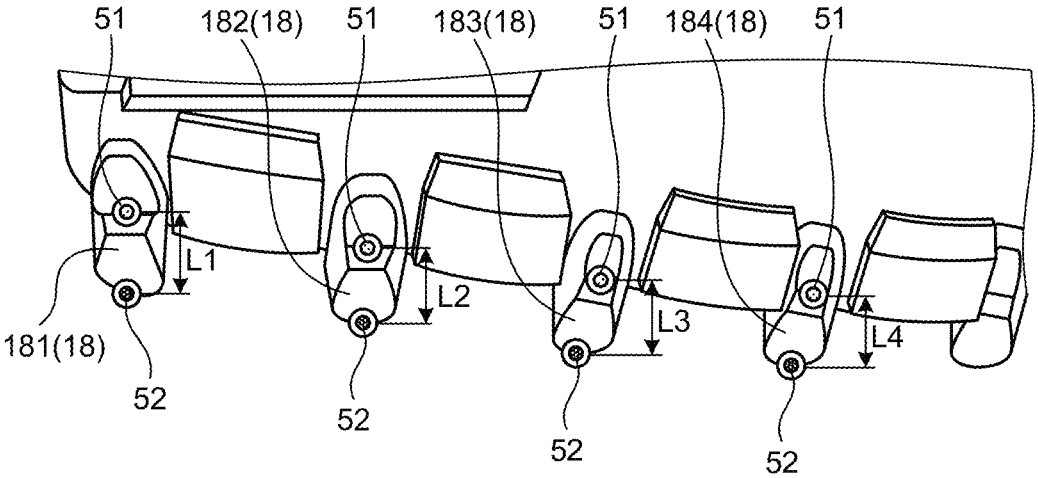
FIG. 18 is a diagram illustrating the defect determination method by the defect determination unit according to the embodiment.

After searching the blade edge 52 corresponding to each of the plurality of bases 51, as illustrated in FIG. 18, the defect determination unit 34B calculates a distance L1 between the base 51 and the blade edge 52 of the bucket tooth 181, a distance L2 between the base 51 and the blade edge 52 of the bucket tooth 182, a distance L3 between the base 51 and the blade edge 52 of the bucket tooth 183, and a distance L4 between the base 51 and the blade edge 52 of the bucket tooth 184. The distance L1 corresponds to a protruding length of the bucket tooth 181 from the bucket body 17. The distance L2 corresponds to a protruding length of the bucket tooth 182 from the bucket body 17. The distance L3 corresponds to a protruding length of the bucket tooth 183 from the bucket body 17. The distance LA corresponds to a protruding length of the bucket tooth 184 from the bucket body 17. After calculating the distances L1, L2, L3, and L4, the defect determination unit 34B calculates a reference tooth length L based on the distances L1, L2, L3, and L4. In the embodiment, the reference tooth length L is a median value of the distances L1, L2, L3, and L4. Note that the defect determination unit 34B may calculate distances L5, L6, L7, and L8 corresponding to the four bucket teeth 185, 186, 187, and 188 by a similar method based on the image data captured by the first imaging device 31R on the right side of the center CL, and may calculate the reference tooth length L based on the distances L1, L2, L3, L4, L5, L6, L7, and L8.

After calculating the reference tooth length L, the defect determination unit 34B determines a dimension threshold related to the protruding length of the bucket teeth 18 from the bucket body 17 based on the reference tooth length L. In the embodiment, the dimension threshold is defined as [ε×L]. This δ is a predetermined fixed value. As described above, in the embodiment, the defect determination unit 34B determines the dimension threshold based on the protruding lengths (L1, L2, L3, and L4) of the plurality of bucket teeth 18 (181, 182, 183, and 184) from the bucket body 17.

The defect determination unit 34B determines whether or not there is a defect in the bucket teeth 18 (181, 182, 183, and 184) based on the dimension threshold. When the protruding length of the bucket tooth 18 from the bucket body 17 is less than the dimension threshold, the defect determination unit 34B determines that there is a defect in the bucket teeth 18. When the protruding length of the bucket tooth 18 from the bucket body 17 is equal to or greater than the dimension threshold, the defect determination unit 34B determines that there is no defect in the bucket teeth 18. In the embodiment, the defect determination unit 34B determines that the bucket tooth 18 has fallen off from the bucket body 17 when the protruding length of the bucket tooth 18 is less than the dimension threshold, and determines that the bucket tooth 18 has not fallen off from the bucket body 17 when the protruding length of the bucket tooth 18 is equal to or greater than the dimension threshold.

Note that the bucket 12 appears large in the image data captured by the first imaging device 31L when a distance between the first imaging device 31L and the bucket 12 is short. The bucket 12 appears small in the image data captured by the first imaging device 31L when the distance between the first imaging device 31L and the bucket 12 is long. When the size of the bucket 12 is different in the image data, the defect determination unit 34B may not be able to correctly determine whether there is a defect in the bucket tooth 18. In the embodiment, the dimension threshold is determined based on the reference tooth length L. As a result, the defect determination unit 34B can determine whether or not there is a defect in the bucket tooth 18 regardless of the distance between the first imaging device 31L and the bucket 12.

The counting unit 34C classifies the measurement data into a plurality of samples based on determination by the defect determination unit 34B. The counting unit 34C classifies the measurement data determined to have no defect into no-defect determination samples. The counting unit 34C classifies the measurement data determined to have a defect into defect determination samples. The counting unit 34C classifies the measurement data for which the defect determination unit 34B has not been able to recognize the bucket tooth 18 into undetermined samples. The counting unit 34C counts the number of no-defect determination samples indicating the measurement data determined to have no defect. The counting unit 34C counts the number of defect determination samples indicating the measurement data determined to have a defect. The counting unit 34C counts the number of undetermined samples indicating the measurement data whose bucket tooth 18 has not been recognized. In the embodiment, the measurement data is the image data, and the sample classified by the counting unit 34C are frames. In the following description, as appropriate, the no-defect determination sample is referred to as a no-defect determination frame, the defect determination sample is referred to as a defect determination frame, and the undetermined sample is referred to as an undetermined frame.

Figure 19:
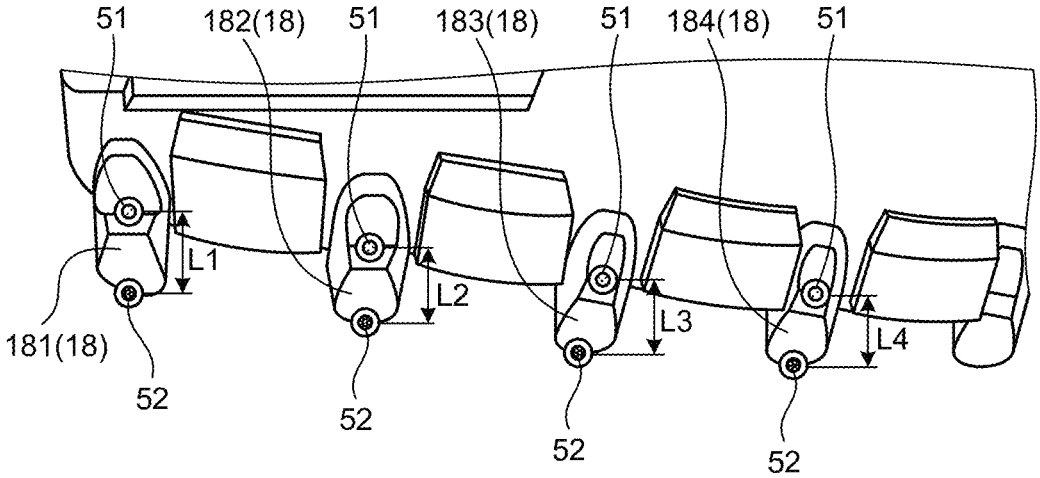
FIG. 19 is a diagram illustrating an example of a no-defect determination frame according to the embodiment.

FIG. 19 is a diagram illustrating an example of the no-defect determination frame according to the embodiment. As illustrated in FIG. 19, each of the distance L1 indicating the protruding length of the bucket tooth 181, the distance L2 indicating the protruding length of the bucket tooth 182, the distance L3 indicating the protruding length of the bucket tooth 183, and the distance L4 indicating the protruding length of the bucket tooth 184 is equal to or greater than the dimension threshold. In this case, the defect determination unit 34B determines that the bucket teeth 18 are non-defective. The counting unit 34C classifies the image data determined to have no defect into the no-defect determination frames.

Figure 20:
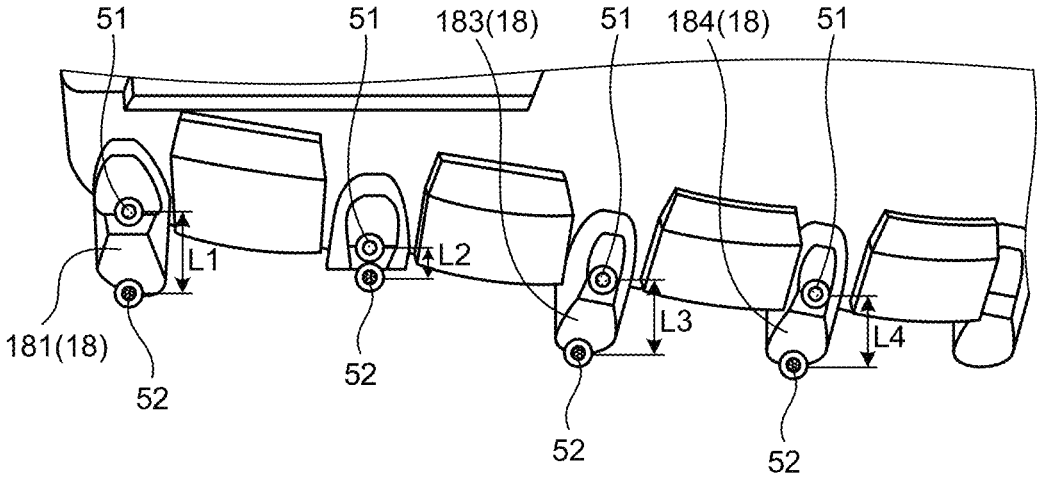
FIG. 20 is a diagram illustrating an example of a defect determination frame according to the embodiment.

FIG. 20 is a diagram illustrating an example of the defect determination frame according to the embodiment. In the example illustrated in FIG. 20, the distance L2 indicating the protruding length of the bucket tooth 182 is less than the dimension threshold. In this case, the defect determination unit 34B determines that the bucket tooth 182 is defective. The counting unit 34C classifies the image data determined to have the defect into the defect determination frames.

The method of determining detachment of the bucket tooth 18, based on the image data captured by the first imaging device 31L on the left side of the center CL, has been described above. The same applies to a method of determining detachment of the bucket tooth 18 based on the image data captured by the first imaging device 31R on the right side of the center CL. The defect determination unit 34B determines detachment of any of the four bucket teeth 185, 186, 187, and 188 based on the image data acquired by the first measurement data acquisition unit 34A from the first imaging device 31R.

The first warning control unit 34D causes the display device 24A to display a symbol 60 indicating the bucket tooth 18. The first warning control unit 34D changes a display pattern of the symbol 60 based on the presence or absence of the defect in the bucket tooth 18.

FIG. 21 is a diagram illustrating an example of the symbol 60 indicating the bucket tooth 18 displayed on the display device 24A according to the embodiment. As illustrated in FIG. 21, when the defect determination unit 34B cannot recognize the bucket tooth 18 in the image data, the first warning control unit 34D causes the display device 24A to display the symbol 60 indicating the bucket tooth 18 that cannot be recognized in a first display pattern. When the defect determination unit 34B determines that there is no defect in the bucket tooth 18 in the image data, the first warning control unit 34D causes the display device 24A to display the symbol 60 indicating the bucket tooth 18 determined to have no defect in a second display pattern. When the defect determination unit 34B determines that there is a defect in the bucket tooth 18 in the image data, the first warning control unit 34D causes the display device 24A to display the symbol 60 indicating the bucket tooth 18 determined to have a defect in a third display pattern.

In the embodiment, the first warning control unit 34D displays the symbol 60 indicating the bucket tooth 18 that cannot be recognized by the defect determination unit 34B in a first color. The first color is, for example, gray. The first warning control unit 34D displays the symbol 60 indicating the bucket tooth 18 determined to have no defect in a second color. The second color is, for example, green. The first warning control unit 34D displays the symbol indicating the bucket tooth 18 determined to be defective in a third color. The third color is, for example, red.

When there is the defect determination frame, the first warning control unit 34D causes the output device 24 to output a warning indicating that there is the defect determination frame. In addition, the first warning control unit 34D changes a warning pattern output from the output device 24 based on the number of defect determination frames counted by the counting unit 34C.

The first warning control unit 34D causes the output device 24 to output the warning in a first pattern when the number of defect determination frames is less than the sample threshold, and causes the output device 24 to output the warning in a second pattern when the number of defect determination frames is equal to or greater than the sample threshold. The sample threshold is a predetermined value.

The output device 24 includes the display device 24A that displays the symbol 60 indicating the bucket tooth 18, and the sound generator 24B that generates a warning sound. The first warning control unit 34D may cause the display device 24A to display the display data in the first pattern when the number of defect determination frames is less than the sample threshold, and may cause the display device 24A to display the display data in the second pattern when the number of defect determination frames is equal to or greater than the sample threshold. The first warning control unit 34D may cause the sound generator 24B to generate the warning sound in the first pattern when the number of defect determination frames is less than the sample threshold, and may cause the sound generator 24B to generate the warning sound in the second pattern when the number of defect determination frames is equal to or greater than the sample threshold.

Figure 22:
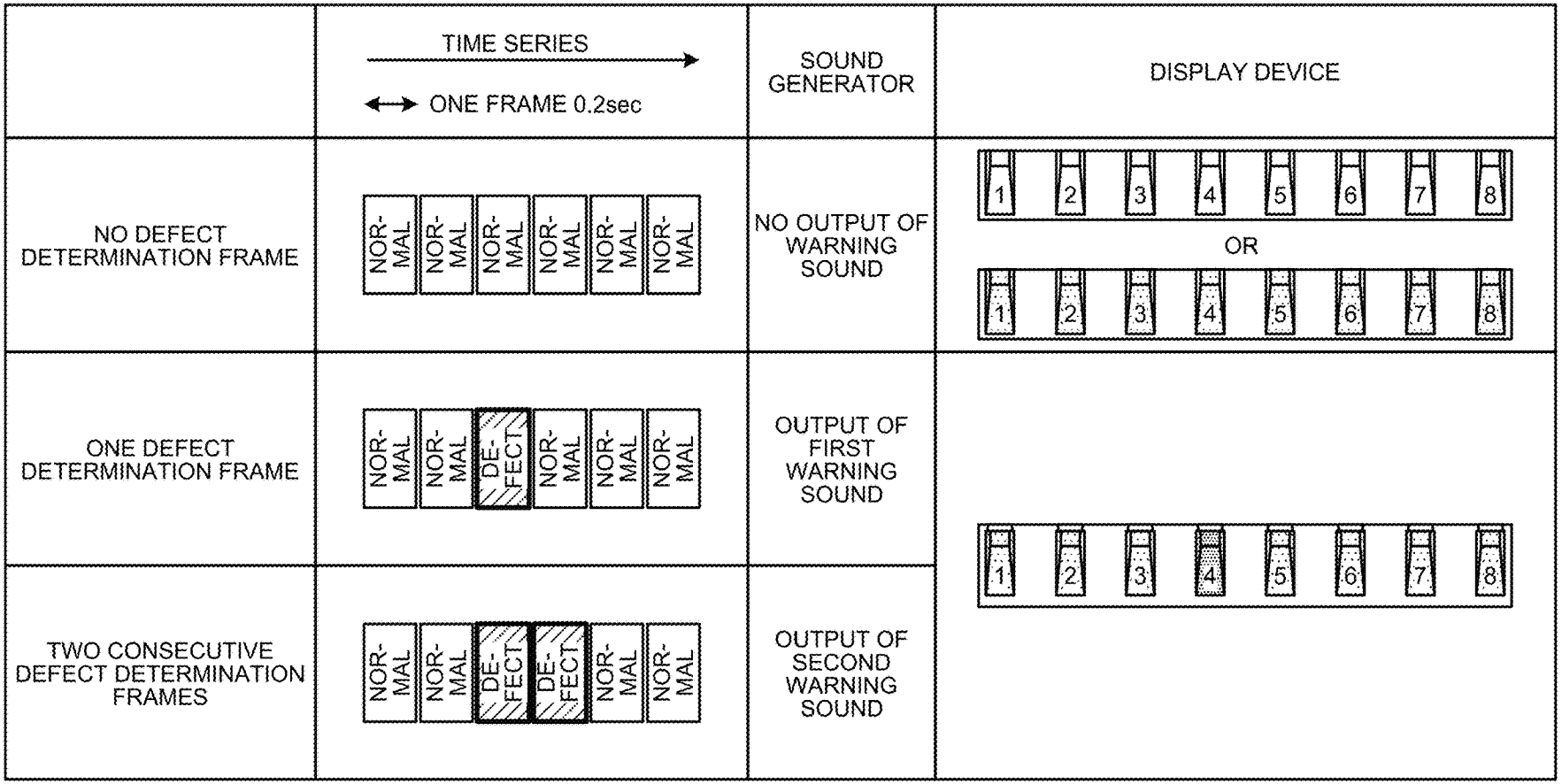
FIG. 22 is a diagram illustrating a relationship between the defect determination frame and a warning pattern according to the embodiment.

FIG. 22 is a diagram illustrating a relationship between the defect determination frames and the warning pattern according to the embodiment. The presence or absence of the defect determination frame is determined at the predetermined frame rate. In an example illustrated in FIG. 22, the presence or absence of the defect determination frame is determined at intervals of 0.2 [sec.]. In FIG. 22, a "normal" frame indicates the no-defect determination frame or the undetermined frame. In FIG. 22, the "defect" frame includes the defect determination frame. In the example illustrated in FIG. 22, the sample threshold is 2.

As illustrated in FIG. 22, when a moving image captured by the first imaging device 31 includes one or both of the undetermined frame and the no-defect determination frame, the warning sound is not output from the sound generator 24B. When the moving image captured by the first imaging device 31 includes only the undetermined frame, the symbol 60 indicating the unrecognizable bucket tooth 18 is displayed in the first display pattern on the display device 24A. When the moving image captured by the first imaging device 31 includes only the no-defect determination frame, the symbol 60 indicating the bucket tooth 18 determined to have no defect is displayed in the second display pattern on the display device 24A.

A plurality of bucket teeth 18 is attached to the bucket body 17. In the embodiment, eight bucket teeth 18 are arranged at intervals in the vehicle width direction. The display device 24A displays a plurality of symbols 60 based on positions of the plurality of bucket teeth 18. On the display device 24A, eight symbols 60 are displayed at intervals in accordance with the positions of the plurality of bucket teeth 181, 182, 183, 184, 185, 186, 187, and 188. When the moving image includes only undetermined frames, all of the eight symbols 60 are displayed in the first display pattern. When the moving image includes only the no-defect determination frames, all of the eight symbols 60 are displayed in the second display pattern.

As illustrated in FIG. 22, when there is one defect determination frame in the moving image, the first warning control unit 34D causes the sound generator 24B to output the first warning sound. When there are two defect determination frames in the moving image captured by the first imaging device 31, the first warning control unit 34D causes the sound generator 24B to output the second warning sound.

In the embodiment, the first warning control unit 34D causes the output device 24 to output the warning in the first pattern when the first measurement data acquisition unit 34A consecutively acquires the image data each being determined as the defect determination frame for the number of pieces of image data less than the sample threshold. The first warning control unit 34D causes the output device 24 to output the warning in the second pattern when the first measurement data acquisition unit 34A consecutively acquires the image data each being determined as the defect determination frame for the number of pieces of image data equal to or greater than the sample threshold.

For example, when the sample threshold is 2 and less than two pieces of image data consecutively acquired by the first measurement data acquisition unit 34A is determined to be the defect determination frame, the first warning control unit 34D causes the sound generator 24B to output the first warning sound. In other words, when the image data acquired before and after the defect determination frame is the no-defect determination frame or the undetermined frame, the first warning control unit 34D causes the sound generator 24B to output the first warning sound. When two or more pieces of image data consecutively acquired by the first measurement data acquisition unit 34A are determined to be the defect determination frames, the first warning control unit 34D causes the sound generator 24B to output the second warning sound. In other words, when the defect determination frame continues for at least two times, the first warning control unit 34D causes the sound generator 24B to output the second warning sound.

Note that even when the defect determination frame does not continue for two times, the first warning control unit 34D may cause the sound generator 24B to output the second warning sound when at least two defect determination frames exist in the moving image per unit time captured by the first imaging device 31.

Note that the sample threshold is arbitrary. For example, the sample threshold may be any number of three or more.

The warning pattern includes a warning sound volume. The output of the warning in the first pattern includes generation of the warning sound in a first volume from the sound generator 24B. The output of the warning in the second pattern includes generation of the warning sound in a second volume larger than the first volume from the sound generator 24B. In the example illustrated in FIG. 22, the volume of the second warning sound is larger than the volume of the first warning sound.

Furthermore, when the defect determination frame exists in the moving image captured by the first imaging device 31, the symbol 60 indicating the bucket tooth 18 determined to have a defect is displayed in the third display pattern on the display device 24A. The first warning control unit 34D displays the symbol 60 indicating the bucket tooth 18 determined to have the defect and the symbol 60 indicating the bucket tooth 18 determined to have no defect in different display patterns. In the example illustrated in FIG. 22, when the bucket tooth 184 is determined to have the defect and the bucket teeth 181, 182, 183, 185, 186, 187, and 188 are determined to have no defect, the first warning control unit 34D displays the symbol indicating the bucket tooth 184 determined to have the defect in the third display pattern, and displays the symbol indicating the bucket teeth 181, 182, 183, 185, 186, 187, and 188 determined to have no defect in the second display pattern.

<Boulder Monitoring Unit>

The boulder monitoring unit 35 includes a second measurement data acquisition unit 35A, a determination criteria setting unit 35B, a warning criteria setting unit 35C, a standard value storage unit 35D, an input data acquisition unit 35E, a driving state acquisition unit 35F, a boulder determination unit 35G, and a second warning control unit 35H.

The second measurement data acquisition unit 35A acquires measurement data of the ground 200 from the second imaging device 32 at a predetermined sampling rate. As described above, the measurement data of the ground 200 includes the image data of the ground 200 captured by the second imaging device 32. The sampling rate includes the frame rate. The second measurement data acquisition unit 35A acquires the image data of the ground 200 from the second imaging device 32 at the predetermined frame rate. The second measurement data acquisition unit 35A acquires the image data of the ground 200 in front of the front tires 6F.

The determination criteria setting unit 35B sets determination criteria for determining the presence or absence of the boulder 240 on the ground 200 in the image data.

Figure 23:
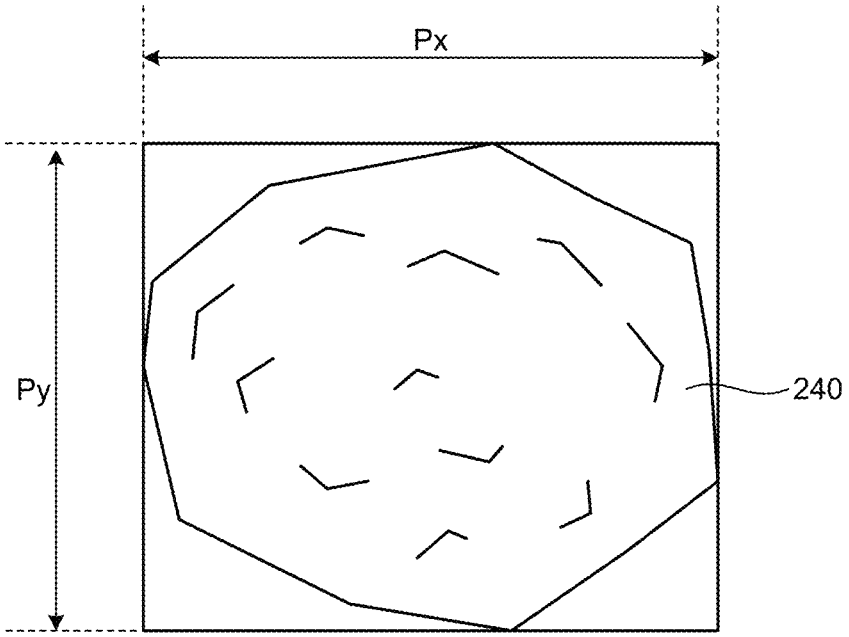
FIG. 23 is a diagram illustrating determination criteria according to the embodiment.

FIG. 23 is a diagram illustrating the determination criteria according to the embodiment. In the embodiment, the determination criteria include dimensions of the boulder 240 in the image data. The dimensions of the boulder 240 include the number of pixels of the boulder 240 in the image data. In the image data, a threshold related to the dimensions of the boulder 240 is set. The threshold related to the dimensions of the boulder 240 includes a threshold Px related to a horizontal dimension of the boulder 240 and a threshold Py related to a vertical dimension of the boulder 240. The standard value storage unit 35D stores a standard value (initial value) related to the determination criteria. The standard value is a recommended value related to the threshold related to the dimensions of the boulder 240. The determination criteria setting unit 35B sets the determination criteria based on the standard value. In the embodiment, the determination criteria setting unit 35B sets the threshold related to the dimensions of the boulder 240 based on the standard value. The threshold is the standard value.

The warning criteria setting unit 35C sets warning criteria for outputting a warning from the output device 24.

Figure 24:
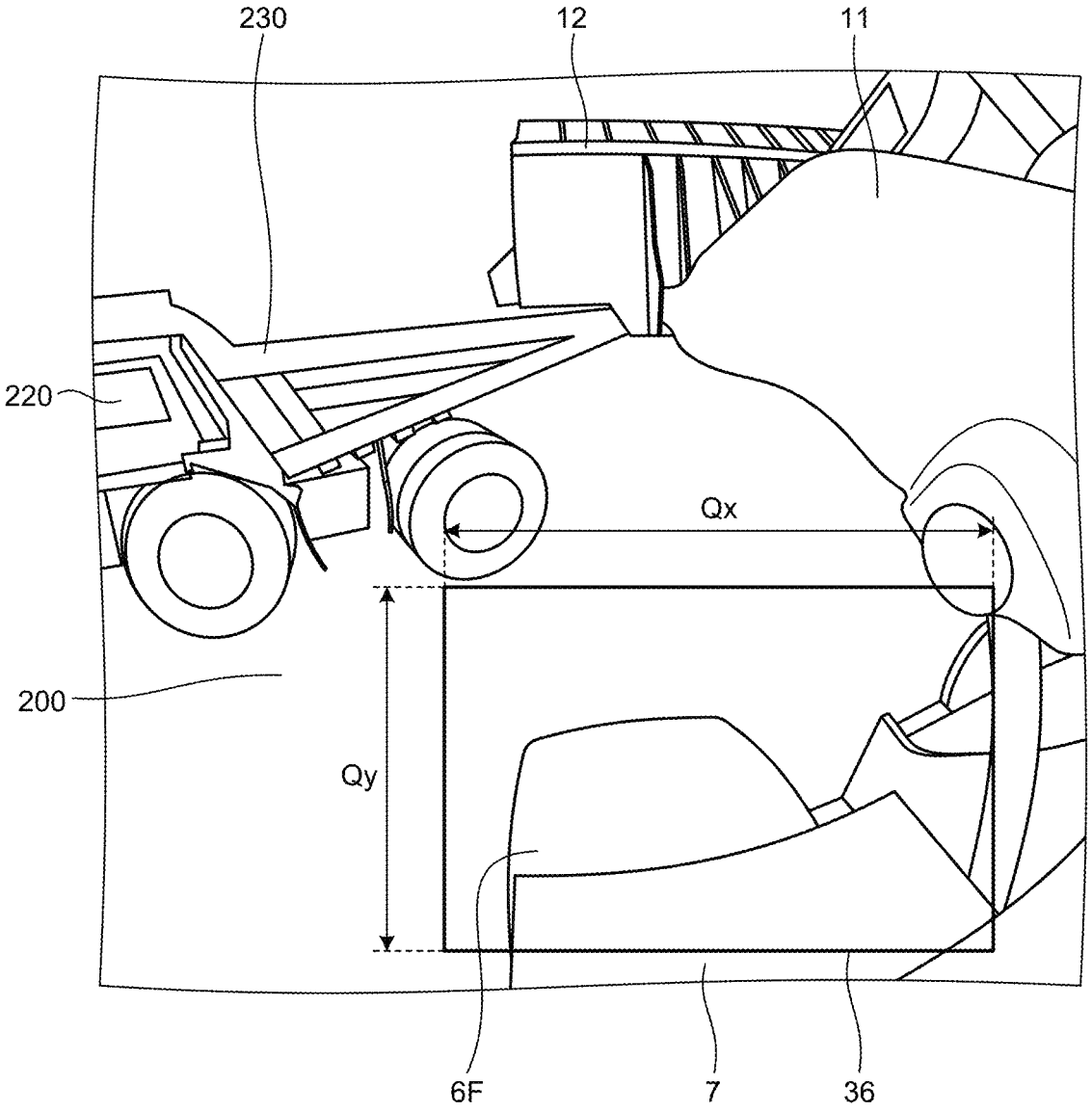
FIG. 24 is a diagram illustrating warning criteria according to the embodiment.

FIG. 24 is a diagram illustrating the warning criteria according to the embodiment. In the embodiment, the warning criteria includes a warning area 36 set on at least a part of the ground 200.

The setting of the warning criteria includes setting of dimensions of the warning area 36. The dimensions of the warning area 36 include the number of pixels of the warning area in the image data. As illustrated in FIG. 24, a dimension Qx of the warning area 36 in the horizontal direction and a dimension Qy of the warning area 36 in the vertical direction are set in the image data.

The setting of the warning area 36 includes setting of a position of the warning area 36. The setting of the position of the warning area 36 includes setting of the position of the warning area 36 in the image data. The warning criteria setting unit 35C sets the warning area 36 in a part of the ground 200 in front of the front tires 6F. The standard value storage unit 35D stores a standard value (initial value) related to the warning criteria. The standard value is a recommended value related to the dimensions and position of the warning area 36. The warning criteria setting unit 35C sets the warning criteria based on the standard value. In the embodiment, the warning criteria setting unit 35C sets the dimensions and position of the warning area 36 in the image data based on the standard value.

The input data acquisition unit 35E acquires input data from the input device 25. The driver can change the setting of the determination criteria or the setting of the warning criteria by operating the input device 25. The determination criteria setting unit 35B sets determination criteria based on the input data. The warning criteria setting unit 35C sets the warning criteria based on the input data.

Figure 25:
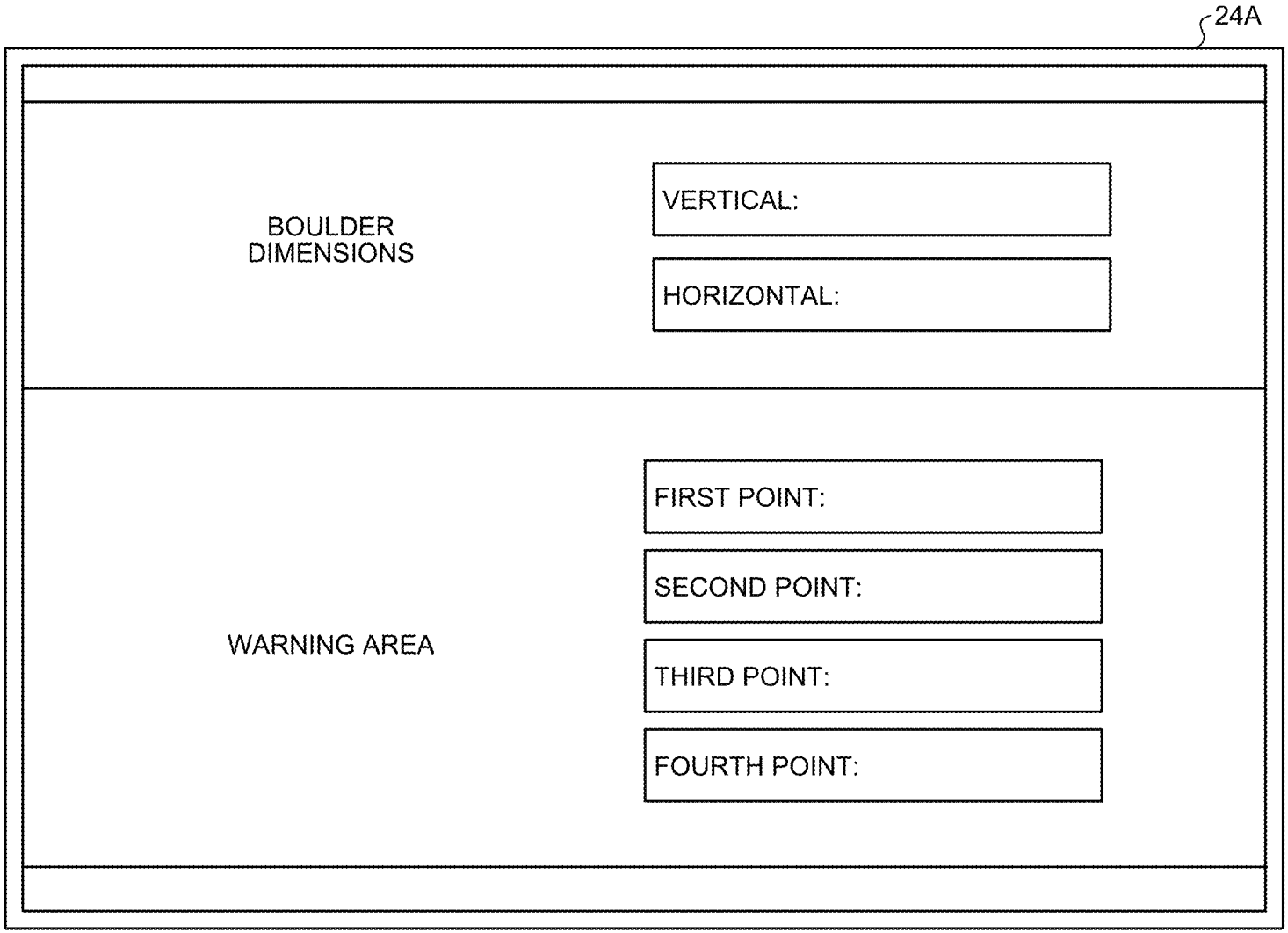
FIG. 25 is a diagram illustrating an example of a setting screen of the determination criteria and the warning criteria according to the embodiment.

FIG. 25 is a diagram illustrating an example of a setting screen of the determination criteria and the warning criteria according to the embodiment. As illustrated in FIG. 25, the determination criteria setting unit 35B causes the display device 24A to display a setting screen of the determination criteria. The warning criteria setting unit 35C causes the display device 24A to display a setting screen of the warning criteria. The driver can perform at least one of the change of the setting of the determination criteria and the change of the setting of the warning criteria by operating the input device 25 while viewing the setting screen.

The driving state acquisition unit 35F acquires state data indicating the state of the drive system 40. The drive controller 48 inputs the state data indicating the state of the drive system 40 to the monitoring controller 33. The driving state acquisition unit 35F determines the state of the drive system 40 based on the state data from the drive controller 48.

In the embodiment, the state of the drive system includes an operation state of the transmission 44. The transmission 44 switches the traveling direction of the work machine 1 between the forward and backward directions. The transmission 44 includes the forward gear 44F that operates to move the work machine 1 forward and the reverse gear 44R that operates to move the work machine 1 backward. The boulder determination unit 35G determines the presence or absence of the boulder 240 on the ground 200 based on the image data acquired by the second measurement data acquisition unit 35A. The boulder determination unit 35G determines the presence or absence of the boulder 240 on the ground 200 in the image data. In the embodiment, the boulder determination unit 35G determines the presence or absence of the boulder 240 on the ground 200 in front of the front tire 6F in the image data.

The boulder determination unit 35G may determine the presence or absence of the boulder 240 using, for example, artificial intelligence (AI) that analyzes the input data by the algorithm and outputs the output data. The boulder determination unit 35G may determine the presence or absence of the boulder 240 using, for example, a pattern matching method.

In the embodiment, the boulder determination unit 35G determines the presence or absence of the boulder 240 on the ground 200 in the image data based on the determination criteria. The boulder determination unit 35G determines that there is the boulder 240 when the dimensions of the boulder 240 exceed the thresholds (Px and Py), and determines that there is no boulder 240 when the dimensions of the boulder 240 is equal to or less than the thresholds (Px and Py). The boulder determination unit 35G may determine that the boulder 240 exists when the dimensions of the boulder 240 exceed one of the threshold Px and the threshold Py. The boulder determination unit 35G may determine that the boulder 240 exists when the dimensions of the boulder 240 exceed both the threshold Px and the threshold Py.

In the embodiment, the boulder determination unit 35G determines the presence or absence of the boulder 240 in both the states in which the boom 11 is raised and lowered. The boulder determination unit 35G constantly determines whether the boulder 240 exists in the cycle work described with reference to FIG. 8.

The second warning control unit 35H causes the output device 24 to output the warning based on the presence or absence of the boulder 240 on the ground 200 in front of the front tire 6F. The second warning control unit 35H causes the output device 24 to output the warning based on the determination of the presence or absence of the boulder 240 by the boulder determination unit 35G and the relationship between the boulder 240 and the warning criteria. The warning criteria includes the warning area 36 set in at least a part of the ground 200. The warning area 36 is set in a part of the ground 200 in front of the front tires 6F. When it is determined that the boulder 240 exists, the second warning control unit 35H causes the output device 24 to output the warning based on the positional relationship between the boulder 240 and the warning area 36. When it is determined that the boulder 240 exists in the warning area 36, the second warning control unit 35H causes the output device 24 to output the warning indicating that the boulder 240 exists in the warning area 36.

In the embodiment, the second warning control unit 35H controls the output device 24 based on the state data indicating the state of the drive system 40 acquired by the driving state acquisition unit 35F. The state of the drive system 40 includes the operation state of the transmission 44. The transmission 44 switches the traveling direction of the work machine 1 between the forward and backward directions. The second warning control unit 35H outputs the warning when it is determined that the boulder 240 exists on the ground 200 in the traveling direction of the work machine 1 determined by the transmission 44. For example, when the transmission 44 is in a neutral state or in a state where the reverse gear 44R is engaged, the second warning control unit 35H does not output the warning indicating that the boulder 240 exists even when it is determined that the boulder 240 exists on the ground 200 in front of the front tires 6F. In a state where it is determined that the boulder 240 exists on the ground 200 in front of the front tires 6F and the transmission 44 is changed, for example, from the neutral state to the state the forward gear 44F is engaged, the warning indicating that the boulder 240 exists starts to be output. In the embodiment, when the forward gear 44F is engaged in the state where it is determined that the boulder 240 exists on the ground 200 in front of the front tires 6F, the second warning control unit 35H outputs the warning indicating that the boulder 240 exists even when the work machine 1 is not traveling.

[Defect Monitoring Method]

Figure 26:
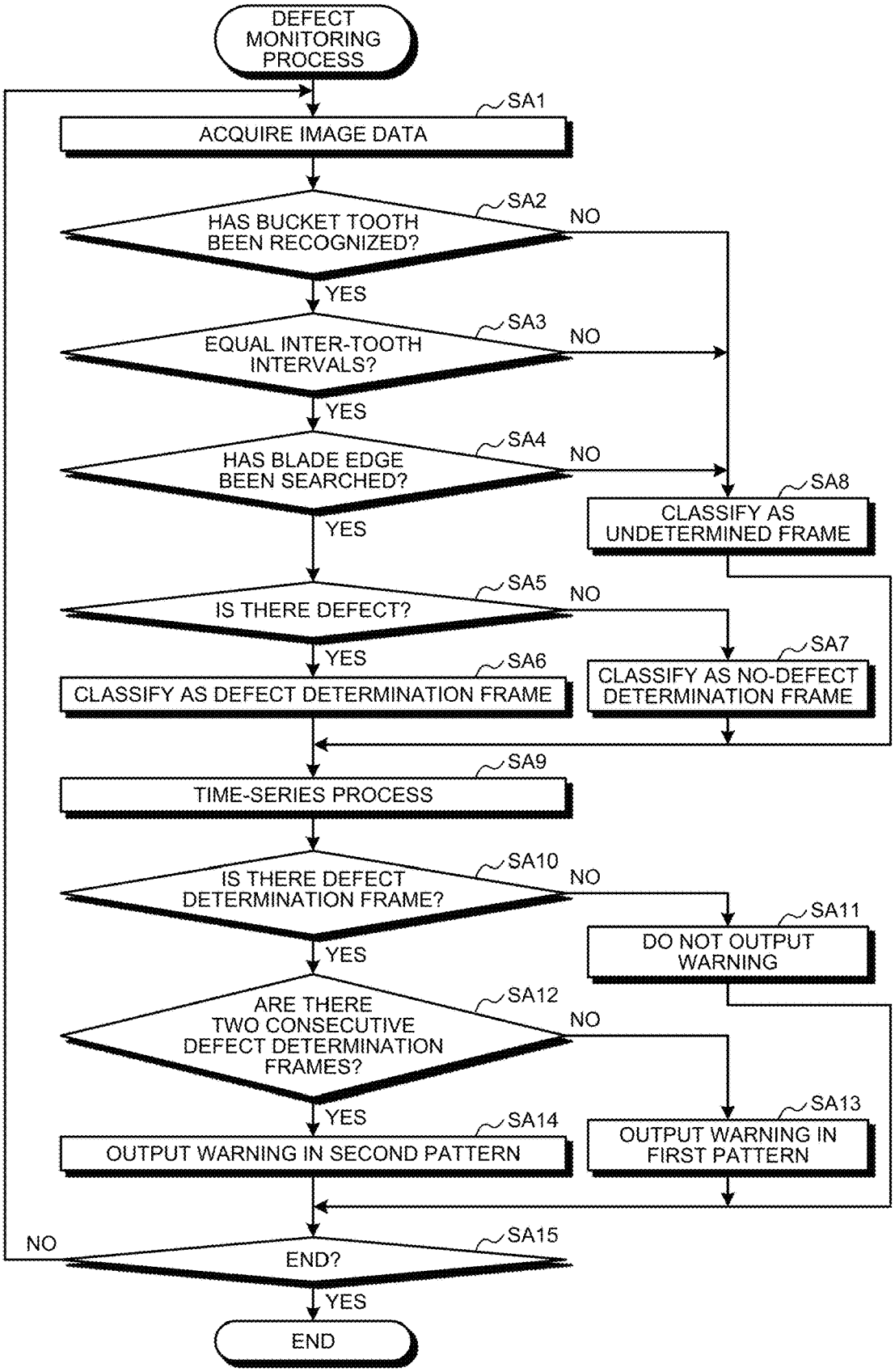
FIG. 26 is a flowchart illustrating a defect monitoring method of the working equipment according to the embodiment.

FIG. 26 is a flowchart illustrating a defect monitoring method of the working equipment 10 according to the embodiment.

The first measurement data acquisition unit 34A acquires the image data of the working equipment 10 from the first imaging device 31 (Step SA1).

As described with reference to FIG. 15, after recognizing the bucket teeth 18 in the image data acquired by the first measurement data acquisition unit 34A, the defect determination unit 34B estimates the base 51 and the blade edge 52 of each of the plurality of bucket teeth 18 (Step SA2).

In Step SA2, when the bucket teeth 18 are recognized and the base 51 and the blade edge 52 are estimated (Step SA2: Yes), as described with reference to FIG. 16, the defect determination unit 34B calculates the distances G1, G2, and G3 between the pair of bucket teeth 18 adjacent to each other. The defect determination unit 34B determines whether the distances G1, G2, and G3 are equal intervals (Step SA3).

In Step SA3, when it is determined that the distances G1, G2, and G3 are equal intervals (Step SA3: Yes), as described with reference to FIG. 17, the defect determination unit 34B sets the search range 53 and searches the blade edge 52 corresponding to the base 51. The defect determination unit 34B determines whether the blade edge 52 has been searched (Step SA4).

In Step SA4, when it is determined that the blade edge 52 has been searched (Step SA4: Yes), as described with reference to FIG. 18, the defect determination unit 34B determines the dimension threshold based on the distances L1, L2, L3, and L4. The defect determination unit 34B determines the presence or absence of a defect in the bucket teeth 18 based on the dimension threshold (Step SA5).

In Step SA5, when it is determined that there is a defect in the bucket teeth 18 in the image data (Step SA5: Yes), the counting unit 34C classifies the image data determined to have the defect as the defect determination frame (Step SA6).

In Step SA5, when it is determined that there is no defect in the bucket teeth 18 in the image data (Step SA5: No), the counting unit 34C classifies the image data determined to have no defect as the no-defect determination frame (Step SA7).

When the bucket teeth 18 cannot be recognized in the image data (Step SA2: No) in Step SA2, when the distances G1, G2, and G3 are determined to be not equal in the image data (Step SA3: No) in Step SA3, or when the blade edge 52 is determined to be not searchable in the image data (Step SA5: No) in Step SA4, the counting unit 34C classifies the image data as the undetermined frame (Step SA8).

The counting unit 34C performs a time-series process on the image data classified (Step SA9).

The counting unit 34C determines whether or not the defect determination frame exists (Step SA10).

In Step SA10, when it is determined that there is no defect determination frame (Step SA10: No), no warning is output from the output device 24 (Step SA11).

In Step SA10, when it is determined that there is the defect determination frame (Step SA10: Yes), the counting unit 34C determines whether or not there is the defect determination frame equal to or greater than the sample threshold. In the embodiment, the counting unit 34C determines whether the defect determination frame continues for at least two times (Step SA12).

In Step SA12, when it is determined that the defect determination frame does not continue for two times (Step SA12: No), the first warning control unit 34D outputs the warning in the first pattern. As described with reference to FIG. 22, in the embodiment, the first warning control unit 34D causes the sound generator 24B to output the first warning sound having the first volume (Step SA13).

In Step SA12, when it is determined that the defect determination frame continues for at least two times (Step SA12: Yes), the first warning control unit 34D outputs the warning in the second pattern. As described with reference to FIG. 22, in the embodiment, the first warning control unit 34D causes the sound generator 24B to output the second warning sound having the second volume larger than the first volume (Step SA14).

The defect monitoring unit 34 determines whether or not to end a defect monitoring process (Step SA15).

In Step SA15, when it is determined to continue the defect monitoring process (Step SA15: No), the process returns to Step SA1.

In Step SA15, when it is determined to end the defect monitoring process (Step SA15: Yes), the defect monitoring process is ended.

The process from Step SA1 to Step SA15 is performed at the predetermined frame rate.

[Boulder Monitoring Method]

Figure 27:
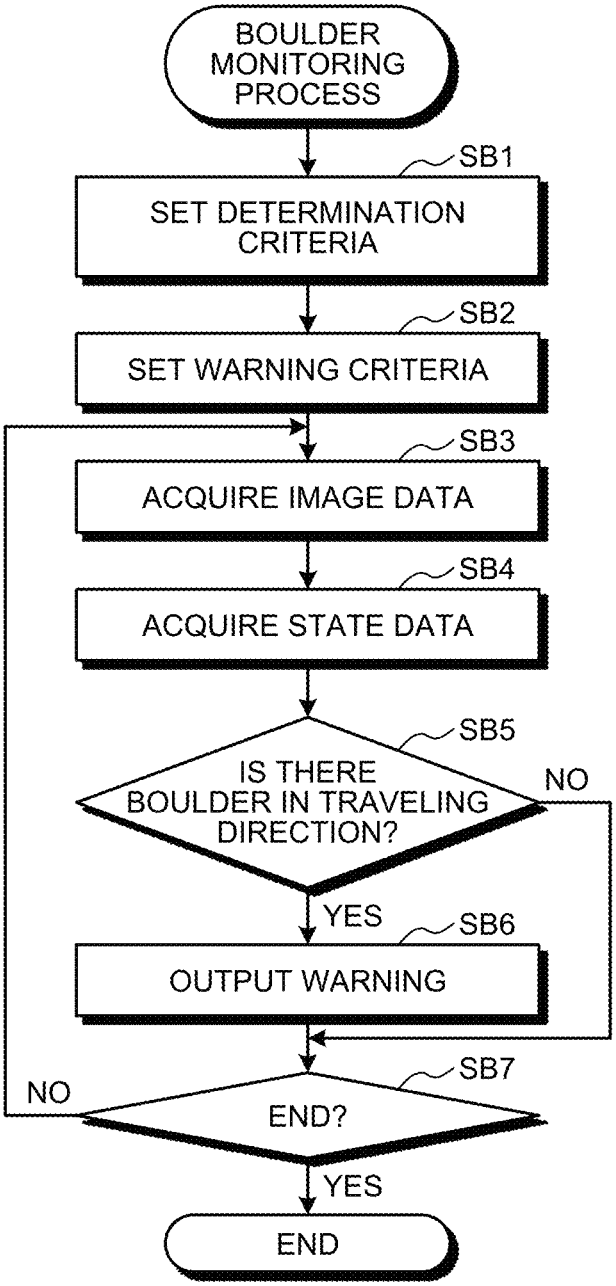
FIG. 27 is a flowchart illustrating a method of monitoring a boulder on a ground according to the embodiment.

FIG. 27 is a flowchart illustrating a method of monitoring a boulder the ground 200 according to the embodiment.

The determination criteria setting unit 35B sets the determination criteria for determining the presence or absence of the boulder 240 on the ground 200. The determination criteria setting unit 35B sets the threshold Px and the threshold Py related to the dimensions of the boulder 240 based on the standard value stored in the standard value storage unit 35D. When the driver operates the input device 25, the determination criteria setting unit 35B sets the threshold Px and the threshold Py based on the input data (Step SB1).

The warning criteria setting unit 35C sets warning criteria for outputting a warning from the output device 24. The warning criteria setting unit 35C sets the warning area 36 based on the standard value stored in the standard value storage unit 35D. The setting of the warning area 36 includes the setting of the dimension Qx and the dimension Qy and the setting of the position of the warning area 36. When the driver operates the input device 25, the warning criteria setting unit 35C sets the warning area 36 based on the input data. (Step SB2).

The second measurement data acquisition unit 35A acquires the image data of the ground 200 from the second imaging device 32. The second measurement data acquisition unit 35A acquires the image data of the ground 200 in front of the front tires 6F (Step SB3).

The driving state acquisition unit 35F acquires the state data of the transmission 44 (Step SB4).

The boulder determination unit 35G determines whether the boulder 240 exists on the ground 200 in the traveling direction of the work machine 1 determined by the transmission 44. When the forward gear 44F is engaged, the boulder determination unit 35G determines whether the boulder 240 exists on the ground 200 in front of the front tires 6F. The boulder determination unit 35G determines whether the boulder 240 exists on the ground 200 in front of the front tires 6F in a state where the transmission 44 is operated to move the work machine 1 forward (Step SB5).

In Step SB5, when it is determined that the boulder 240 exists on the ground 200 in front of the front tires 6F (Step SB5: Yes), the second warning control unit 35H causes the output device 24 to output the warning. When it is determined that the boulder 240 exists on the ground 200 in front of the front tires 6F in the state where the transmission 44 is operated to move the work machine 1 forward, the second warning control unit 35H causes the output device 24 to output the warning (Step SB6).

In Step SB5, when it is determined that no boulder 240 exists on the ground 200 in front of the front tires 6F (Step SB5: Yes), no warning is output from the output device 24.

The boulder monitoring unit 35 determines whether or not to end a boulder monitoring process (Step SB7).

In Step SB7, when it is determined to continue the boulder monitoring process (Step SB7: No), the process returns to Step SB3.

In Step SB7, when it is determined to end the boulder monitoring process (Step SB7: Yes), the boulder monitoring process is ended.

The process from Step SB3 to Step SB7 is performed at the predetermined frame rate.

[Display Device]

Figure 28:
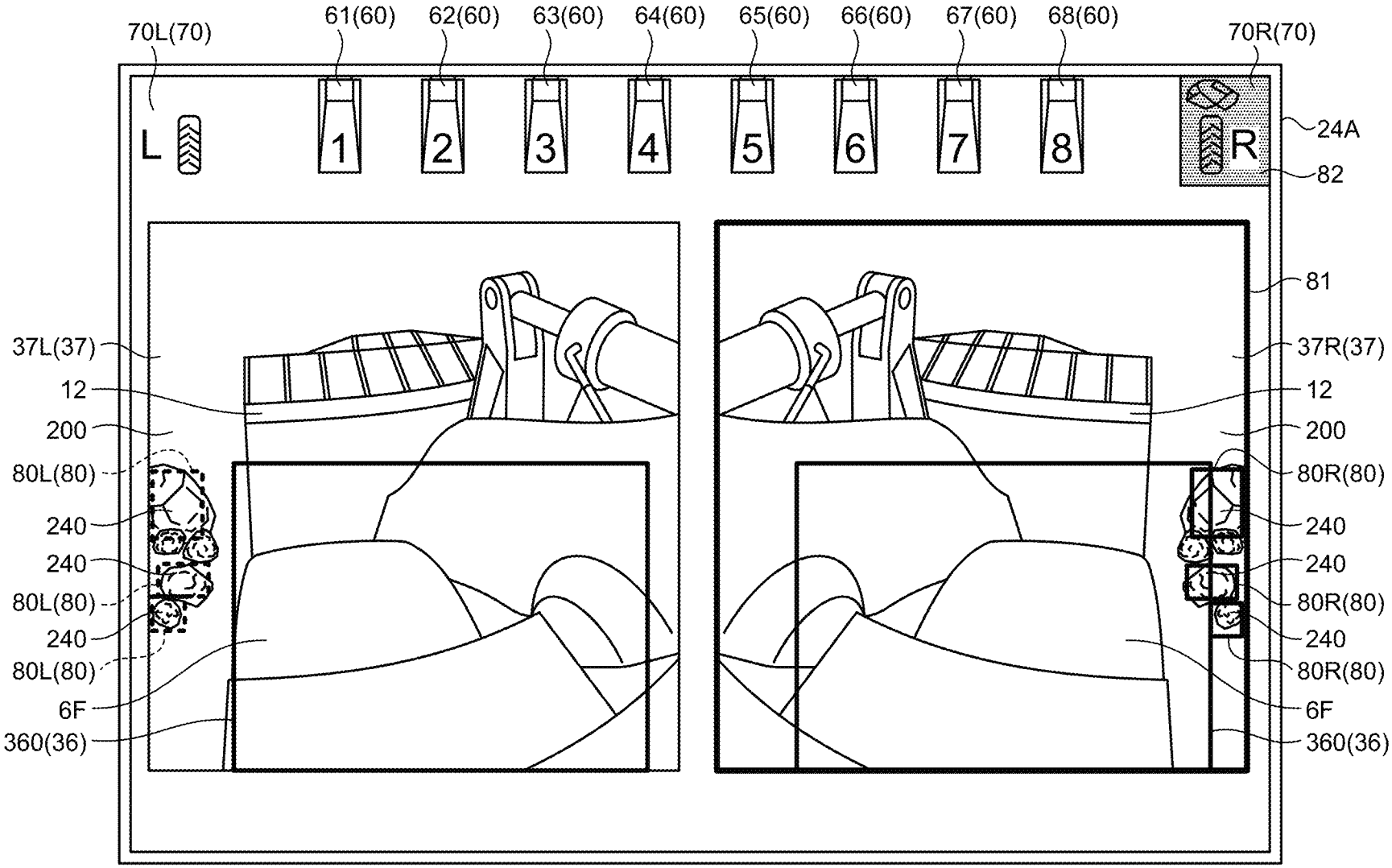
FIG. 28 is a diagram illustrating an example of an output device according to the embodiment.

FIG. 28 is a diagram illustrating an example of the display device 24A according to the embodiment. As illustrated in FIG. 28, the second warning control unit 35H causes the display device 24A to display a target image 37 indicating the ground 200 generated based on the image data acquired by the second measurement data acquisition unit 35A. The target image 37 includes a target image 37L indicating image data captured by the second imaging device 32L on the left side and a target image 37R indicating image data captured by the second imaging device 32R on the right side. Target image 37L and the target image 37R are displayed side by side on the display screen of the display device 24A. The target image 37L and the target image 37R are simultaneously displayed on the display screen of the display device 24A. The target image 37L is displayed in a left region of the display screen of the display device 24A. The target image 37R is displayed in a right region of the display screen of the display device 24A.

The second warning control unit 35H causes the display device 24A to display an area image 360 indicating the warning area 36. The second warning control unit 35H superimposes the area image 360 on the target image 37 to display the image on the display device 24A. The area image 360 indicating the warning area 36 set to include the ground 200 in front of the front tire 6F on the left side is displayed on the display device 24A in a state of being superimposed on the target image 37L. The area image 360 indicating the warning area 36 set to include the ground 200 in front of the front tire 6F on the right side is displayed on the display device 24A in a state of being superimposed on the target image 37R.

The second warning control unit 35H causes the display device 24A to display a symbol 70 indicating the front tire 6F. The symbol 70 includes a symbol 70L indicating the front tire 6F on the left side and a symbol 70R indicating the front tire 6F on the right side.

The second warning control unit 35H causes the output device 24 to output the warning indicating that the boulder 240 exists on the ground 200 in front of the front tires 6F. To cause the output device 24 to output the warning includes causing the display device 24A to display a warning image indicating that the boulder 240 exists on the ground 200 in front of the front tires 6F. To cause the output device 24 to output the warning includes causing the sound generator 24B to generate the warning sound indicating that the boulder 240 exists on the ground 200 in front of the front tires 6F.

In the embodiment, the warning image includes a frame image 80 displayed so as to surround the boulder 240 in the target image 37, a frame image 81 displayed at a peripheral edge of the target image 37, and a background image 82 of the symbol 70.

The second warning control unit 35H displays the frame image 80 on the display device 24A so that the boulder 240 is highlighted.

In the example illustrated in FIG. 28, the boulder 240 in the target image 37L is arranged outside the warning area 36. When the boulder determination unit 35G determines that the boulder 240 exists outside the warning area 36, the second warning control unit 35H causes the display device 24A to display a frame image 80L in a first pattern.

In the example illustrated in FIG. 28, at least a part of the boulder 240 in the target image 37R is located inside the warning area 36. When the boulder determination unit 35G determines that the boulder 240 exists inside the warning area 36, the second warning control unit 35H causes the display device 24A to display a frame image 80R in a second pattern different from the first pattern.

The second warning control unit 35H displays each of the frame image 80L and the frame image 80R on the display device 24A such that the boulder 240 located inside the warning area 36 is highlighted more than the boulder 240 located outside the warning area 36. In the example illustrated in FIG. 28, the frame image 80R is displayed by a solid line, and the frame image 80L is displayed by a dotted line. Note that the frame image 80R may be displayed in the first color, and the frame image 80L may be displayed in the second color. As the first color, red is exemplified. As the second color, green is exemplified. The second warning control unit 35H displays the frame image 81 on the display device 24A such that the target image 37 in which at least a part of the boulder 240 exists inside the warning area 36 is highlighted.

In the example illustrated in FIG. 28, at least a part of the boulder 240 displayed in the target image 37R exists inside the warning area 36. The boulder 240 displayed in the target image 37L exists outside the warning area 36. The second warning control unit 35H displays the frame image 81 on the display device 24A such that the target image 37R is highlighted more than the target image 37L.

The second warning control unit 35H displays the background image 82 on the display device 24A such that the front tire 6F having a high possibility of passing over the boulder 240 is highlighted.

In the example in FIG. 28, the front tire 6F on the right side is highly likely to pass over the boulder 240. In other words, there is a high possibility that the front tire 6F on the right side steps on the boulder 240 by moving the work machine 1 forward. The second warning control unit 35H displays the background image 82 of the symbol 70R on the display device 24A such that the front tire 6F on the right side that has a high possibility of passing over the boulder 240 is highlighted.

Note that, in the example illustrated in FIG. 28, when there is a high possibility that the front tire 6F on the left side passes over the boulder 240, the second warning control unit 35H can display the background image 82 of the symbol 70L on the display device 24A such that the front tire 6F on the left side that has a high possibility of passing over the boulder 240 is highlighted.

The first warning control unit 34D causes the display device 24A to display a symbol 60 indicating the bucket tooth 18. The first warning control unit 34D displays the plurality of symbols 60 based on the positions of the plurality of bucket teeth 18. The symbol 60 includes a symbol 61 indicating the bucket tooth 181, a symbol 62 indicating the bucket tooth 182, a symbol 63 indicating the bucket tooth 183, a symbol 64 indicating the bucket tooth 184, a symbol 65 indicating the bucket tooth 185, a symbol 66 indicating the bucket tooth 186, a symbol 67 indicating the bucket tooth 187, and a symbol 68 indicating the bucket tooth 188.

The plurality of symbols 60 is displayed in an upper region of the display screen of the display device 24A. Among the plurality of symbols 60, the symbol 61 is displayed on the leftmost side, the symbol 62 is arranged on the left side next to the symbol 61, the symbol 63 is arranged on the left side next to the symbol 62, the symbol 64 is arranged on the left side next to the symbol 63, the symbol 65 is arranged on the left side next to the symbol 64, the symbol 66 is arranged on the left side next to the symbol 65, the symbol 67 is arranged on the left side next to the symbol 66, and the symbol 68 is arranged on the rightmost side.

FIG. 28 illustrates the example in which the defect determination unit 34B cannot recognize eight bucket teeth 18 and the eight symbols 60 are displayed in the first display pattern.

Figure 29:
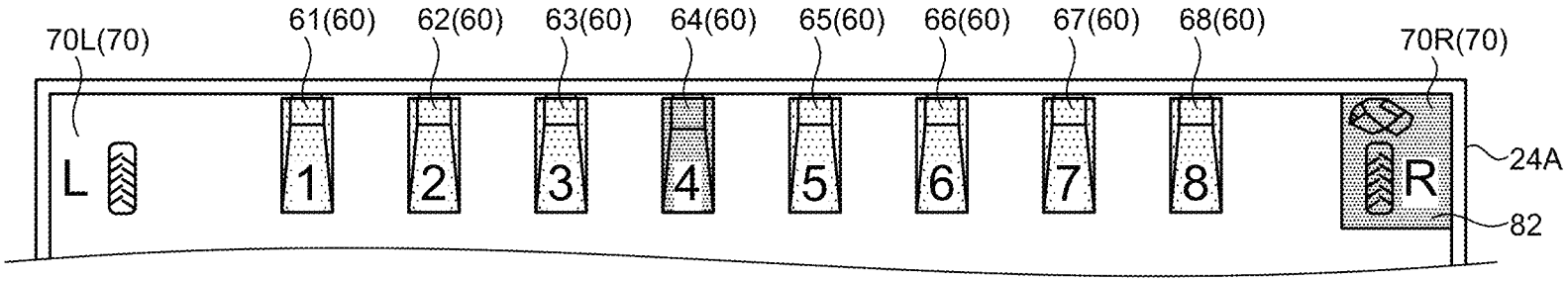
FIG. 29 is a diagram illustrating an example of the output device according to the embodiment.

FIG. 29 is a diagram illustrating an example of the display device 24A according to the embodiment. Note that FIG. 29 is a diagram obtained by extracting the upper region of the display device 24A.

FIG. 29 illustrates the example of the symbols 60 when the defect determination unit 34B determines the presence or absence of a defect in each of the eight bucket teeth 18. As illustrated in FIG. 29, the first warning control unit 34D changes the display patterns of the symbols 60 based on the presence or absence of the defect in the bucket teeth 18. The first warning control unit 34D displays the symbol 60 indicating the bucket tooth 18 determined to have the defect and the symbol 60 indicating the bucket tooth 18 determined to have no defect in different display patterns. As illustrated in FIG. 29, when it is determined that there is a defect in the bucket tooth 184 and it is determined that there is no defect in the bucket teeth 181, 182, 183, 185, 186, 187, and 188, the first warning control unit 34D displays the symbol 64 in the third display pattern to indicate that the bucket tooth 184 is determined to have the defect, and displays the symbols 61, 62, 63, 65, 66, 67, and 68 in the second display pattern to indicate that the bucket teeth 181, 182, 183, 185, 186, 187, and 188 are determined to have no defect. The first warning control unit 34D causes the display device 24A to display the symbol 64 in the third color, and causes the display device 24A to display the symbols 61, 62, 63, 65, 66, 67, and 68 in the second color. The third color is, for example, red. The second color is, for example, green.

[Computer System]

Figure 30:
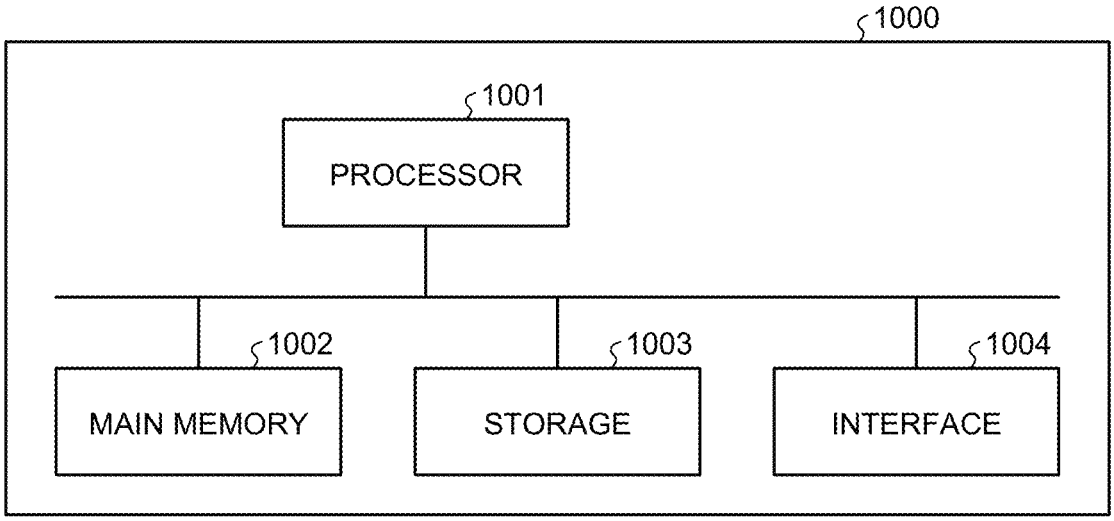
FIG. 30 is a block diagram illustrating a computer system according to the embodiment.

FIG. 30 is a block diagram illustrating a computer system 1000 according to the embodiment. Each of the monitoring controller 33 and the drive controller 48 described above includes the computer system 1000. The computer system 1000 includes a processor 1001 such as a central processing unit (CPU), a main memory 1002 including a nonvolatile memory such as a read only memory (ROM) and a volatile memory such as a random access memory (RAM), a storage 1003, and an interface 1004 including an input/output circuit. Functions of the monitoring controller 33 and the drive controller 48 described above are stored in the storage 1003 as computer programs. The processor 1001 reads the computer program from the storage 1003, develops the computer program in the main memory 1002, and executes the above-described processes according to the program. Note that the computer program may be distributed to the computer system 1000 via a network.

According to the above-described embodiment, the computer program or the computer system 1000 can execute acquisition of measurement data of the ground 200 on which the work machine 1 travels by the rotation of the tires 6 included in the work machine 1 and contacting the ground 200, determination of the presence or absence of the boulder 240 on the ground 200 in the measurement data, and output of a warning from the output device 24 when it is determined that the boulder 240 exists on the ground 200 in the traveling direction of the tires 6.

Effects

As described above, according to the embodiment, the monitoring system 30 includes the second image data acquisition unit 35A that acquires the image data of the ground 200 on which the work machine 1 travels by the rotation of the tires 6 included in the work machine 1 and contacting the ground 200, the boulder determination unit 35G that determines the presence or absence of the boulder 240 on the ground 200 in the image data of the ground 200, and the second warning control unit 35H that causes the output device 24 to output a warning based on the presence or absence of the boulder 240 on the ground 200 in the traveling direction of the tires 6. As a result, the monitoring system 30 can monitor the boulder 240 on the ground 200 during work of the work machine 1. When the boulder 240 exists, a warning is output from the output device 24, so that the driver can drive without stepping on the boulder 240 with the tire 6. As a result, a damage to the tire 6 is suppressed, and occurrence of a problem in traveling of the work machine 1 is suppressed.

The warning area 36 is set in a part of the ground 200 in the traveling direction of the tires 6. The warning area 36 is set on the ground 200 on which the tires 6 are expected to pass. When it is determined that the boulder 240 exists in the warning area 36, the second warning control unit 35H causes the output device 24 to output the warning. When it is determined that no boulder 240 exists in the warning area 36, the second warning control unit 35H may not cause the output device 24 to output the warning. When the boulder 240 exists in the warning area 36, the warning is output from the output device 24, so that the driver can drive without stepping on the boulder 240 with the tire 6. When there is no boulder 240 in the warning area 36, output of an unnecessary warning from the output device 24 is suppressed.

The output device 24 includes a display device 24A that displays an area image 360 indicating the warning area 36. As a result, the driver can recognize the size, shape, and position of the area image 360.

The second warning control unit 35H superimposes the area image 360 on the target image 37 indicating the ground 200 and causes the display device 24A to display the target image 37. As a result, the driver can recognize the relationship between the ground 200 and the warning area 36.

By displaying the warning image indicating the presence of the boulder 240 on the display device 24A, the driver can easily recognize the presence of the boulder 240.

Since the warning sound indicating that the boulder 240 exists is generated from the sound generator 24B, the driver can easily recognize the presence of the boulder 240.

When it is determined that the boulder 240 exists on the ground 200 in the traveling direction of the tires 6 determined by the transmission 44, the second warning control unit 35H causes the output device 24 to output the warning. As a result, the driver can drive, based on the warning, without stepping on the boulder 240 with the tire 6. In addition, since the warning is output when the forward gear 44F is engaged, and the warning is not output when the forward gear 44F is not engaged, it is possible to suppress an unnecessary warning from being output from the output device 24.

The boulder determination unit 35G constantly determines the presence or absence of the boulder 240 in the cycle work. As a result, the driver can drive without stepping on the boulder 240 with the tire 6 in the cycle work.

The second imaging device 32 is disposed on each of the left side and the right side of the center CL of the work machine 1 in the vehicle width direction of the work machine 1. The second imaging device 32L on the left side images the ground 200 in the traveling direction of the front tire 6F on the left side. The second imaging device 32R on the right side images the ground 200 in the traveling direction of the front tire 6F on the right side. As a result, occurrence of a blind spot is suppressed, and the image data of the ground 200 is appropriately acquired.

Another Embodiment

In the above-described embodiment, each of the first imaging device 31 and the second imaging device 32 is disposed in the housing 9 holding the headlight 28. At least one of the first imaging device 31 and the second imaging device 32 may be disposed in a part of the work machine 1 different from the housing 9.

In the above-described embodiment, the second imaging device 32 is disposed above the first imaging device 31. At least a part of the second imaging device 32 may be disposed at the same position as the first imaging device 31 in the vertical direction. The second imaging device 32 may be disposed below the first imaging device 31.

In the above-described embodiment, the defect monitoring unit 34 determines the presence or absence of a defect in the bucket 12 based on the image data of the bucket 12 performing the dumping operation in the cycle work described with reference to FIG. 8. The first imaging device 31 may capture an image of the bucket 12 performing the dumping operation in a work different from the cycle work. The defect monitoring unit 34 may determine the presence or absence of a defect in the bucket 12 based on image data of the bucket 12 performing the dumping operation in a work different from the cycle work. In addition, the image data of the bucket 12 imaged by the first imaging device 31 may not be the image data of the bucket 12 performing the dumping operation as long as it is image data that the defect monitoring unit 34 can recognize a defect in the bucket 12.

In the above-described embodiment, the defect in the bucket teeth 18 is detachment of the bucket tooth 18 from the bucket body 17. The defect in the bucket teeth 18 may be wear of the bucket tooth 18 or breakage of the bucket tooth 18.

In the above-described embodiment, the defect monitoring unit 34 monitors a defect in the bucket tooth 18 as the replacement member. The defect monitoring unit 34 may monitor the defect in the inter-tooth protector 19 as the replacement member. The defect in the inter-tooth protector 19 includes detachment of the inter-tooth protector 19 from the bucket body 17, wear of the inter-tooth protector 19, and breakage of the inter-tooth protector 19.

In the above-described embodiment, the setting of the warning criteria includes the setting of the dimensions of the warning area 36 and the setting of the position of the warning area 36. The setting of the warning criteria may be either the setting of the dimensions of the warning area 36 or the setting of the position of the warning area 36. For example, the position of the warning area 36 may be a predetermined fixed value, and only the dimensions of the warning area 36 may be set. Alternatively, the dimensions of the warning area 36 may be predetermined fixed values, and only the position of the warning area 36 may be set.

In the above-described embodiment, the boulder monitoring unit 35 determines the presence or absence of the boulder 240 on the ground 200 based on the determination criteria, and causes the output device 24 to output the warning based on the relationship between the boulder 240 and the warning criteria. The boulder monitoring unit 35 may determine that there is the boulder 240 when both the determination criteria and the warning criteria are satisfied. In this case, the boulder monitoring unit 35 may use the warning criteria as the determination criteria. In addition, regardless of the determination criteria, the boulder monitoring unit 35 may determine the presence or absence of the boulder 240 on the ground 200, and output the warning when both the determination criteria and the warning criteria are satisfied. In this case, the boulder monitoring unit 35 may use the determination criteria as the warning criteria.

In the above-described embodiment, the second warning control unit 35H displays the area image 360 indicating the warning area 36 on the display device 24A. The second warning control unit 35H may not display the area image 360 indicating the warning area 36 on the display device 24A. The second warning control unit 35H may display the area image 360 indicating the warning area 36 on the display device 24A when it is determined that there is the boulder 240. The second warning control unit 35H may display the area image 360 indicating the warning area 36 on the display device 24A when it is determined that there is the boulder 240 in the warning area 36.

In the above-described embodiment, the second warning control unit 35H causes the output device 24 to output the warning when it is determined that there is the boulder 240 on the ground 200 in front of the front tire 6F in the state where the transmission 44 is operated to move the work machine 1 forward. In addition, when the forward gear 44F is engaged in the state where it is determined that the boulder 240 exists on the ground 200 in front of the front tire 6F, the warning is output from the output device 24 even when the forward movement of the work machine 1 has not yet started. The second warning control unit 35H may cause the output device 24 to output the warning when the work machine 1 is traveling in the traveling direction in the state where it is determined that the boulder 240 exists on the ground 200 in the traveling direction of the front tires 6F regardless of the state of the transmission 44. For example, when a rotation sensor that detects the rotating direction of the tires 6 is provided in the work machine 1, the driving state acquisition unit 35F can determine whether or not the work machine 1 is traveling in the traveling direction based on detection data of the rotation sensor. The second warning control unit 35H may cause the output device 24 to output the warning when the driving state acquisition unit 35F determines that the work machine 1 travels in the traveling direction and the boulder determination unit 35G determines that the boulder 240 exists on the ground 200 in the traveling direction. For example, when the work machine 1 is located on a downhill, the work machine 1 may move forward due to gravity, for example, even when the transmission 44 is in the neutral state or the reverse gear 44R is engaged. The second warning control unit 35H may cause the output device 24 to output the warning when the rotation sensor detects that the work machine 1 moves forward in the state where it is determined that the boulder 240 exists on the ground 200 in front of the front tire 6F.

In the above-described embodiment, when it is determined that the boulder 240 exists on the ground 200 in front of the front tires 6F in the state where the work machine 1 can move forward or is moving forward, the second warning control unit 35H outputs the warning from the output device 24. When it is determined that the boulder 240 exists on the ground 200 behind the rear tire 6R in a state where the work machine 1 can move backward or is moving backward, the second warning control unit 35H may cause the output device 24 to output the warning.

Figure 31:
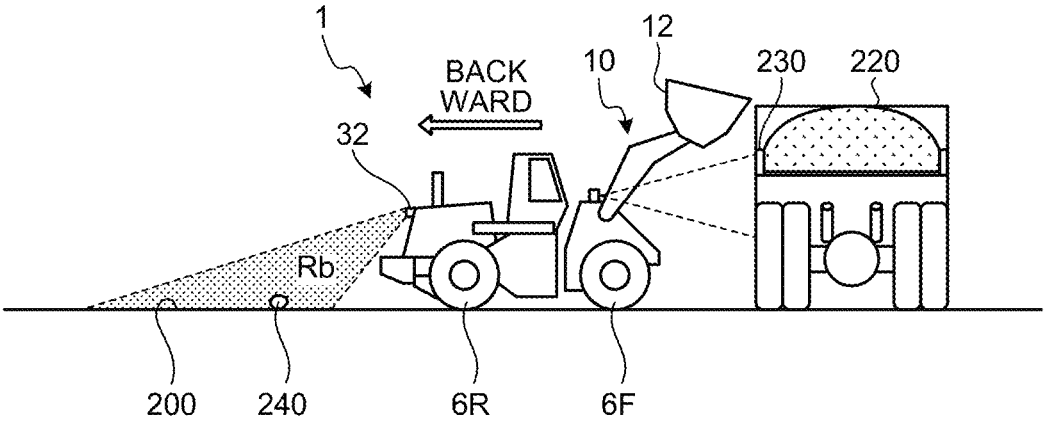
FIG. 31 is a diagram illustrating an operation of a work machine according to another embodiment.

FIG. 31 is a diagram illustrating an operation of the work machine 1 according to another embodiment. As illustrated in FIG. 31, the work machine 1 includes the second imaging device 32 that images the ground 200 behind the rear tires 6R. The second measurement data acquisition unit 35A acquires image data of the ground 200 behind the rear tires 6R from the second imaging device 32. The second warning control unit 35H may cause the output device 24 to output the warning when it is determined that the boulder 240 exists on the ground 200 behind the rear tires 6R in a state where the transmission 44 is operated to move the work machine 1 backward. In addition, the second warning control unit 35H may cause the output device 24 to output the warning when it is determined that the work machine 1 is traveling backward regardless of the state of the transmission 44 and the boulder 240 exists on the ground 200 behind the rear tire 6R.

In the above-described embodiment, the output device 24 is arranged in the driving room of the work machine 1. The output device 24 may be arranged outside the work machine 1.

Figure 32:
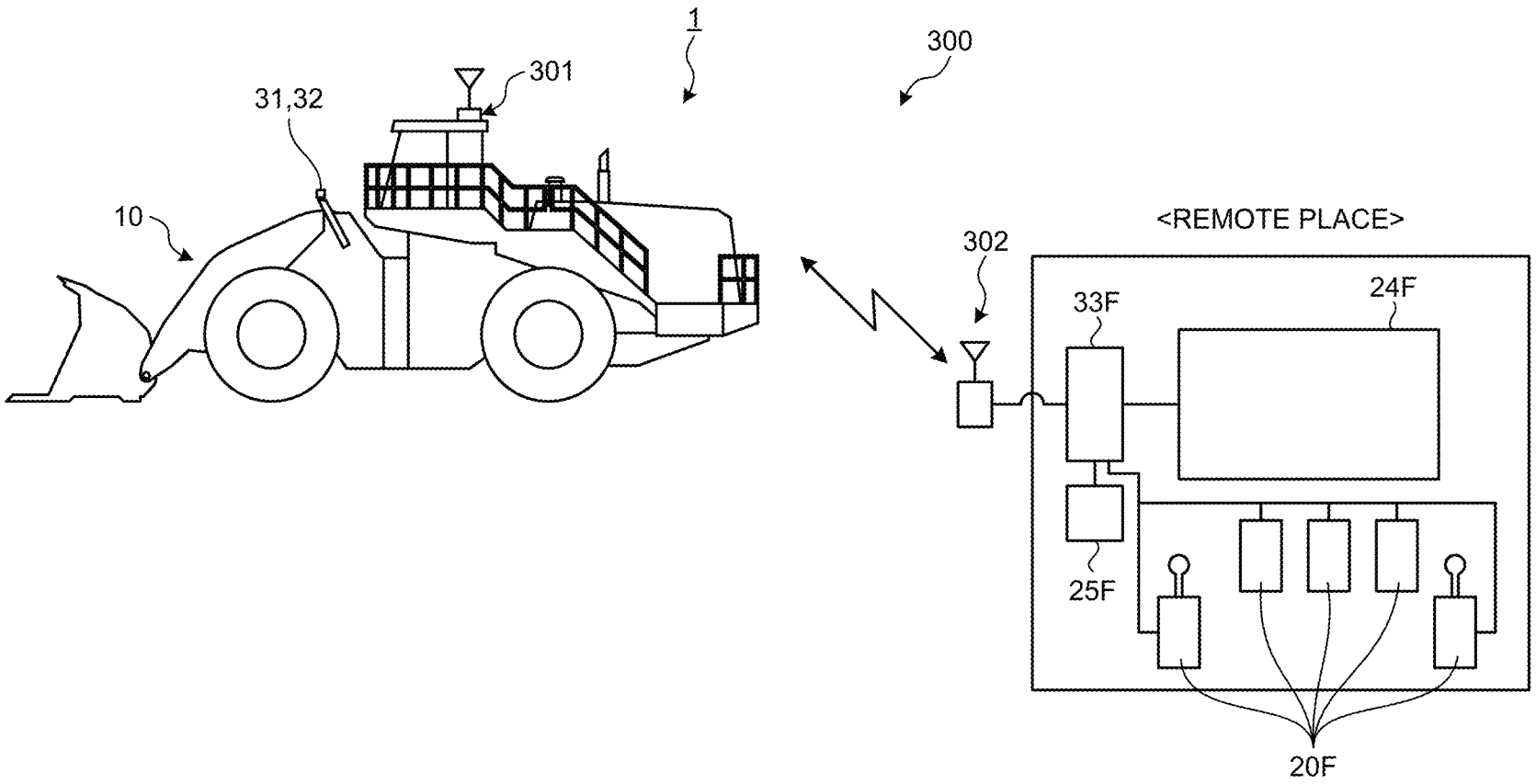
FIG. 32 is a diagram illustrating a monitoring system according to another embodiment.

FIG. 32 is a diagram illustrating a monitoring system 300 according to still another embodiment. In the example illustrated in FIG. 32, the work machine 1 is remotely operated by a driving operation device 20F provided in a remote place from the work machine 1.

Similarly to the above-described embodiment, each of the first imaging device 31 and the second imaging device 32 is provided in the work machine 1. In addition, a remote control imaging device (not illustrated) that images the front of the work machine 1 is provided in the work machine 1. The remote control imaging device captures image data of a view in front of the work machine 1 similar to a view seen through the windshield by the driver seated in the driver's seat in the driving room as illustrated in FIG. 4.

Some or all of an output device 24F, an input device 25F, a monitoring controller 33F, and the driving operation device 20F are disposed in a remote control facility provided in a remote place from the work machine 1. Each of the output device 24F, the input device 25F, the monitoring controller 33F, and the driving operation device 20F is provided separately from the work machine 1. In addition, a remote control display device that displays the image data captured by the remote control imaging device is provided in the remote control facility.

The work machine 1 and the monitoring controller 33F wirelessly communicate with each other via a wireless communication system. The work machine 1 is provided with a wireless communication device 301 of the wireless communication system, and a wireless communication device 302 of the wireless communication system is connected to the monitoring controller 33F. Note that the wireless communication device 301 of the work machine 1 and the wireless communication device 302 of the monitoring controller 33F may communicate via another device.

The image data captured by the remote control imaging device is transmitted to the remote control display device via the wireless communication system. The driver in the remote operation facility can operate the driving operation device 20F while viewing the image data displayed on the remote control display device. An operation signal generated by operating the driving operation device 20F is transmitted to the work machine 1 via the wireless communication system. As a result, the work machine 1 is remotely operated.

The monitoring controller 33F includes the defect monitoring unit 34 and the boulder monitoring unit 35 as described with reference to FIG. 13.

The image data captured by the first imaging device 31 and the second imaging device 32 is transmitted from the work machine 1 to the monitoring controller 33F via the wireless communication system. The defect monitoring unit 34 of the monitoring controller 33F can determine the presence or absence of a defect in the bucket teeth 18 based on the image data captured by the first imaging device 31. In addition, the defect monitoring unit 34 of the monitoring controller 33F can cause the output device 24F to output a warning indicating that there is a defect in the bucket teeth 18. The boulder monitoring unit of the monitoring controller 33F can determine the presence or absence of the boulder 240 on the ground 200 based on the image data imaged by the second imaging device 32. In addition, the boulder monitoring unit 35 of the monitoring controller 33F can cause the output device 24F to output a warning indicating that the boulder 240 exists on the ground 200.

In the above-described embodiment, each of the first measuring device 31 and the second measuring device 32 is an imaging device. At least one of the first measuring device 31 and the second measuring device 32 may be a laser device. At least one of the first measuring device 31 and the second measuring device 32 may be a radar device. The laser device irradiates a measurement target with a laser beam to acquire measurement data of the measurement target. The radar device irradiates a measurement target with a sound wave to acquire measurement data of the measurement target. The laser device can irradiate the working equipment 10 with a laser beam and acquire measurement data of the working equipment 10 at a predetermined sampling rate. The radar device can irradiate the working equipment 10 with a sound wave and acquire measurement data of the working equipment 10 at a predetermined sampling rate. The defect monitoring unit 34 can change the warning pattern output from the output device 24 based on the number of defect determination samples indicating the measurement data determined to have the defect in the working equipment 10.

In the above-described embodiment, the work machine 1 is a wheel loader. The work machine 1 may be another work machine such as a bulldozer or a hydraulic excavator. Each of the bulldozer and the hydraulic excavator has working equipment and a crawler belt that rotates in a state of being in contact with the ground 200. The crawler belt is a rotating member that rotates in the state of being in contact with the ground 200. When the crawler belt rotates, the work machine travels.

REFERENCE SIGNS LIST

1 WORK MACHINE
2 VEHICLE BODY

2A JOINT MECHANISM
2F FRONT VEHICLE BODY
2R REAR VEHICLE BODY
3 CAB
4 TRAVELING DEVICE
5 WHEEL
5F FRONT WHEEL
5R REAR WHEEL
6 TIRE
6F FRONT TIRE
6R REAR TIRE
7 FRONT FENDER
8 SUPPORT
9 HOUSING
10 WORKING EQUIPMENT
11 BOOM
12 BUCKET
12E END
12M OPENING
13 BOOM CYLINDER
14 BUCKET CYLINDER
15 BELL CRANK
16 BUCKET LINK
17 BUCKET BODY
17A LOWER PLATE
17B UPPER PLATE
17C LEFT PLATE
17D RIGHT PLATE
18 BUCKET TOOTH
19 INTER-TOOTH PROTECTOR
20 DRIVING OPERATION DEVICE
20A ACCELERATOR PEDAL
20B BRAKE PEDAL
20F DRIVING OPERATION DEVICE
21 OPERATION PANEL
22 MONITOR DEVICE
23 REAR VIEW MONITOR DEVICE
24 OUTPUT DEVICE
24A DISPLAY DEVICE
24B SOUND GENERATOR
24F OUTPUT DEVICE
25 INPUT DEVICE
25F INPUT DEVICE
27 PILLAR
28 HEADLIGHT
29 BLINKER LAMP
30 MONITORING SYSTEM
31 FIRST IMAGING DEVICE (FIRST MEASURING DEVICE)
31I FIRST IMAGING DEVICE
31R FIRST IMAGING DEVICE
32 SECOND IMAGING DEVICE (SECOND MEASURING DEVICE)
32L SECOND IMAGING DEVICE
32R SECOND IMAGING DEVICE
33 MONITORING CONTROLLER
33F MONITORING CONTROLLER
34 DEFECT MONITORING UNIT
34A FIRST MEASUREMENT DATA ACQUISITION UNIT
34B DEFECT DETERMINATION UNIT
34C COUNTING UNIT
34D FIRST WARNING CONTROL UNIT
35 BOULDER MONITORING UNIT
35A SECOND MEASUREMENT DATA ACQUISITION UNIT
35B DETERMINATION CRITERIA SETTING UNIT
35C WARNING CRITERIA SETTING UNIT
35D STANDARD VALUE STORAGE UNIT
35E INPUT DATA ACQUISITION UNIT
35F DRIVING STATE ACQUISITION UNIT
35G BOULDER DETERMINATION UNIT
35H SECOND WARNING CONTROL UNIT
36 WARNING AREA
37 TARGET IMAGE
37L TARGET IMAGE
37R TARGET IMAGE
40 DRIVE SYSTEM
41 ENGINE
42 FUEL INJECTION DEVICE
43 POWER TAKE-OFF
44 TRANSMISSION
44F FORWARD GEAR
44R REVERSE GEAR
45F FRONT AXLE
45R REAR AXLE
46 HYDRAULIC PUMP
47 CONTROL VALVE
48 DRIVE CONTROLLER
50 RECOGNITION RANGE
51 BASE
52 BLADE EDGE
53 SEARCH RANGE
60 SYMBOL
61 SYMBOL
62 SYMBOL
63 SYMBOL
64 SYMBOL
65 SYMBOL
66 SYMBOL
67 SYMBOL
68 SYMBOL
70 SYMBOL
70L SYMBOL
70R SYMBOL
80 FRAME IMAGE
80L FRAME IMAGE
80R FRAME IMAGE
81 FRAME IMAGE
82 BACKGROUND IMAGE
181 BUCKET TOOTH
182 BUCKET TOOTH
183 BUCKET TOOTH
184 BUCKET TOOTH
185 BUCKET TOOTH
186 BUCKET TOOTH
187 BUCKET TOOTH
188 BUCKET TOOTH
191 INTER-TOOTH PROTECTOR
192 INTER-TOOTH PROTECTOR
193 INTER-TOOTH PROTECTOR
194 INTER-TOOTH PROTECTOR
195 INTER-TOOTH PROTECTOR
196 INTER-TOOTH PROTECTOR
197 INTER-TOOTH PROTECTOR
200 GROUND
210 NATURAL GROUND
220 DUMP TRUCK
230 DUMP BODY
240 BOULDER
300 MONITORING SYSTEM
301 WIRELESS COMMUNICATION DEVICE
302 WIRELESS COMMUNICATION DEVICE
360 AREA IMAGE

1000 COMPUTER SYSTEM
1001 PROCESSOR
1002 MAIN MEMORY
1003 STORAGE
1004 INTERFACE
CL CENTER
FX ROTATION AXIS
G REFERENCE INTER-TOOTH DISTANCE
G1 DISTANCE
G2 DISTANCE
G3 DISTANCE
L REFERENCE TOOTH LENGTH
L1 DISTANCE
L2 DISTANCE
L3 DISTANCE
L4 DISTANCE
M1 ARROW
M2 ARROW
M3 ARROW
M4 ARROW
Px THRESHOLD
Py THRESHOLD
Qx DIMENSION
Qy DIMENSION
Ra MEASURING RANGE
Rb MEASURING RANGE
RX ROTATION AXIS
α FIRST ANGLE OF VIEW
β SECOND ANGLE OF VIEW

The invention claimed is:

1. A monitoring system for a work machine, comprising:
a processor, the processor being configured to:
acquire measurement data of a ground on which the work machine travels by rotation of a rotating member included in the work machine from a measuring device disposed in the work machine that measures the ground, the rotating member contacting the ground;
determine presence or absence of a boulder on the ground in the measurement data; and
output a warning based on the presence or absence of the boulder on the ground in a traveling direction of the rotating member; and
wherein the work machine includes a transmission that switches the traveling direction of the work machine, where the processor is configured to output the warning when it is determined that the boulder exists on the ground in the traveling direction decided by the transmission.

2. The monitoring system for the work machine according to claim 1, wherein the processor further configured to:
set a warning area in a part of the ground in the traveling direction,
and output the warning when it is determined that the boulder exists in the warning area.

3. The monitoring system for the work machine according to claim 2, wherein
the warning output includes displaying an area image indicating the warning area on a display device.

4. The monitoring system for the work machine according to claim 3, wherein
the display device displays a target image indicating the ground, the target image being generated based on the measurement data, and
the processor is configured to superimpose the area image on the target image to display the target image on the display device.

5. The monitoring system for the work machine according to claim 4, wherein
the warning output includes displaying, on the display device, a warning image indicating that the boulder exists.

6. The monitoring system for the work machine according to claim 5, wherein
the processor is configured to display the warning image such that the boulder is highlighted.

7. The monitoring system for the work machine according to claim 6, wherein
the warning image includes a frame image displayed so as to surround the boulder.

8. The monitoring system for the work machine according to claim 1, wherein
the warning output includes generating a warning sound from a sound generator, and
the warning output includes generating, from the sound generator, the warning sound indicating that the boulder exists.

9. The monitoring system for the work machine according to claim 1, wherein
the warning output includes displaying a target image indicating the ground on a display device, the target image being generated based on the measurement data, and
the warning output includes displaying, on the display device, a warning image indicating that the boulder exists.

10. The monitoring system for the work machine according to claim 1, wherein the processor is further configured to
acquire measurement data of the ground in front of the rotating member, and
output the warning when it is determined that the boulder exists on the ground in front of the rotating member in a state where the transmission is operated to move the work machine forward.

11. The monitoring system for the work machine according to claim 1, wherein
the rotating member includes a front rotating member and a rear rotating member disposed behind the front rotating member, and wherein the processor is further configured to:
acquire measurement data of the ground in front of the front rotating member, and
output the warning when it is determined that the boulder exists on the ground in front of the front rotating member in a state where the transmission is operated to move the work machine forward.

12. The monitoring system for the work machine according to claim 1, wherein the processor is further configured to:
acquire measurement data of the ground behind the rotating member, and
output the warning when it is determined that the boulder exists on the ground behind the rotating member in a state where the transmission is operated to move the work machine backward.

13. The monitoring system for the work machine according to claim 1, wherein
the rotating member includes a front rotating member and a rear rotating member disposed behind the front rotating member, and wherein the processor is further configured to:
acquire measurement data of the ground behind the rear rotating member, and output the warning when it is determined that the boulder exists on the ground behind the rear rotating member in a state where the transmission is operated to move the work machine backward.

14. The monitoring system for the work machine according to claim 1, wherein the processor is further configured to:

determine whether the work machine is traveling in the traveling direction, and output the warning when it is determined that the work machine is traveling in the traveling direction and the boulder exists on the ground in the traveling direction.

15. The monitoring system for the work machine according to claim 1, wherein the work machine includes working equipment having a boom and a bucket, and the processor is further configured to determine the presence or absence of the boulder in both states where the boom is rising and lowering.

16. The monitoring system for the work machine according to claim 1, wherein the work machine includes a headlight, and a housing that holds the headlight, and the measuring device disposed in the housing.

17. The monitoring system for the work machine according to claim 16, wherein the measuring device is disposed on each of a left side and a right side of a center of the work machine in a vehicle width direction of the work machine, the rotating member is disposed on each of the left side and the right side of the center of the work machine in the vehicle width direction of the work machine, the measuring device on the left side measures the ground in the traveling direction of the rotating member on the left side, and the measuring device on the right side measures the ground in the traveling direction of the rotating member on the right side.

18. The monitoring system for the work machine according to claim 16, wherein the measuring device includes an imaging device, and the measurement data includes image data of the ground.

19. A method for monitoring a work machine, comprising:

acquiring measurement data of a ground on which the work machine travels by rotation of a rotating member included in the work machine, from a measuring device disposed in the work machine that measures the ground, the rotating member contacting the ground;

determining presence or absence of a boulder on the ground in the measurement data; and outputting a warning when it is determined that the boulder exists on the ground in a traveling direction of the rotating member; and outputting the warning when it is determined that the boulder exists on the ground in the traveling direction decided by a transmission of the work machine that switches the traveling direction of the work machine.

* * * * *